US006089304A

United States Patent [19]

Mullet et al.

[11] Patent Number: 6,089,304

[45] Date of Patent: Jul. 18, 2000

[54] COMPACT TRACK SYSTEM WITH REAR MOUNT COUNTERBALANCE SYSTEM FOR SECTIONAL DOORS

[75] Inventors: Willis J. Mullet, Pensacola Beach, Fla.; Derek S. Paquette, Robertsdale, Ala.

[73] Assignee: Wayne-Dalton Corp., Mt. Hope, Ohio

[21] Appl. No.: 09/101,310

[22] PCT Filed: Nov. 7, 1996

[86] PCT No.: PCT/US96/17811

§ 371 Date: Jul. 2, 1998

§ 102(e) Date: Jul. 2, 1998

[87] PCT Pub. No.: WO98/20224

PCT Pub. Date: May 14, 1998

[51] Int. Cl.[7] ..... E05D 15/38

[52] U.S. Cl. ..... 160/209; 160/193

[58] Field of Search ..... 160/201, 209, 160/193, 207, 191, 192

[56] References Cited

U.S. PATENT DOCUMENTS

| | | | |
|---|---|---|---|
| 1,886,490 | 11/1932 | Lynch . | |
| 1,897,391 | 2/1933 | Kelly . | |
| 1,940,485 | 12/1933 | Beeman et al. | 268/59 |
| 1,990,870 | 2/1935 | Kelly | 20/20 |
| 1,994,142 | 3/1935 | Madsen | 20/19 |
| 2,020,831 | 11/1935 | Greegor | 20/20 |
| 2,040,080 | 5/1936 | Collins | 20/20 |
| 2,045,060 | 6/1936 | Wheatley | 20/20 |
| 2,093,019 | 9/1937 | Norberg | 20/20 |
| 2,227,571 | 1/1941 | Clark | 20/20 |
| 2,264,642 | 12/1941 | Rowe | 20/20 |
| 2,338,205 | 1/1944 | Rowe | 160/191 |
| 2,538,626 | 1/1951 | Olsen | 160/201 |
| 2,656,561 | 10/1953 | McKee | 16/104 |
| 4,119,133 | 10/1978 | Wolf | 160/209 |
| 4,878,529 | 11/1989 | Hormann | 160/201 |

FOREIGN PATENT DOCUMENTS

| | | | |
|---|---|---|---|
| 27 37 655 | 8/1977 | Germany | E05D 15/24 |
| 282658 | 9/1952 | Switzerland . | |

*Primary Examiner*—David M. Purol

*Attorney, Agent, or Firm*—Renner, Kenner Greive, Bobak Taylor & Weber

[57] ABSTRACT

An overhead door system including, a sectional door (D") having top, bottom, and intermediate panels (321, 324, 322) hinged for moving between a closed vertical position and an open horizontal position, top rollers (332) on the top panel, bottom rollers (341) on the bottom panel, intermediate rollers (337) positioned between the top rollers and the bottom rollers, inner vertical tracks (351) for engaging the intermediate rollers, transition tracks (353) connected to the inner vertical tracks and curving through an angle of approximately ninety degrees for directing the travel of the intermediate rollers, horizontal tracks (355) extending from the transition tracks for engaging the intermediate rollers to support the door in the open horizontal position, and outer vertical tracks (357) for guiding the bottom rollers in a substantially vertical path paralleling said inner vertical tracks and having upper extremities (357') that are inwardly offset in the direction of the transition tracks.

22 Claims, 12 Drawing Sheets

310
312
313
315
365
366
367
385
386
387
388
370
363
373
372
C
331
332
360
330
D"
O
357'
359
353
350
358
357
321
369
C
351
335
337
336
322

COMPACT TRACK SYSTEM WITH REAR MOUNT COUNTERBALANCE SYSTEM FOR SECTIONAL DOORS

TECHNICAL FIELD

The present invention relates generally to a counterbalancing system for sectional doors. More particularly, the present invention relates to a counterbalancing system for sectional doors which move in and out of position relative to a vertical opening. More specifically, the present invention relates to a compact counterbalancing system for use in conjunction with multi-section doors which are movable from a horizontal position to a vertical position in proximity to a door frame, particularly in circumstances where there is minimal clearance between a door frame and the overhead or minimal clearance to the side of the door frame.

BACKGROUND ART

Counterbalancing systems for sectional doors have been employed for many years. Common examples of such sectional doors are the type employed as garage doors in homes, commercial and utility buildings, and similar applications. Counterbalancing systems originally solved the need for providing mechanical assistance in the instance of very large doors for commercial installations and smaller garage doors for residential use, which were normally constructed of heavy, relatively thick wood or metal components. More recently, counterbalancing systems have been increasingly used to permit opening and closing operations by a single person and to facilitate the use of electric motors, preferably of limited size, to power the opening and closing of such doors.

Most such counterbalancing systems utilize drums which carry cables attached to the garage door. Commonly the drums are mounted above the frame defining the door opening, with a drum positioned at each end of the door such that the cables may be conveniently connected proximate the lower lateral corners of the garage door. Basically, the door is moved toward the closed position, blocking the door opening due to gravity acting on the door as it moves from a substantially horizontal, open position above and inwardly of the door frame to a closed position. The path of the door in opening and closing is commonly defined by a track arrangement which interacts with rollers attached to the various sections of the door. The cable drums are classically interconnected with springs in a wide variety of ways so that they are progressively loaded as the door is lowered to prevent uncontrolled descent of the door and employ stored energy to assist in raising the door during subsequent opening operation.

The prevailing type of counterbalancing system for garage doors for homes normally having a seven-foot high door involves the utilization of torsion springs mounted on a shaft which is coaxial with or mounts the drums. In such systems, it is established practice to utilize cable drums having a diameter of approximately 3½ inches to 4 inches. A torsion spring or springs mounted outwardly of the shaft has a diameter normally in excess of 1½ inches to maintain an appropriate spring index. The drums and spring are normally mounted on a tubular shaft having a diameter of approximately 1 inch, which holds the springs and transmits torque from the springs to the drums which are attached to the tubing.

These conventional torsion counterbalancing systems require that the tube mounting the drums be positioned above the horizontal track of the door to permit raising the door as high in the door opening as possible to accommodate higher vehicles and to otherwise make optimum use of the door opening. With a counterbalancing system thus positioned and employing conventional 3½ to 4-inch cable drums, there is a requirement that there be a minimum of 13 to 14 inches above the door opening as overhead clearance to permit the mounting of these counterbalancing systems. However, a disadvantage of these conventional systems is the increasing requirement for a counterbalancing system which can be installed in a structure having a lesser overhead clearance. Frequently, construction parameters dictate a lower ceiling within a garage or the use of beams, supports, or other objects which do not provide the necessary headroom clearance of 13 to 14 inches required for the utilization of these conventional counterbalancing systems.

In an attempt to accommodate the requirements for decreased overhead clearance, efforts have been made to modify these conventional counterbalancing systems. If the drums and tube with the mounted springs are merely moved downwardly, one or more of these elements interfere with the door during its opening and closing motion. One alternative which has been employed to solve reduced headroom requirements is to move the drums outboard or laterally of the tracks and lowered to a point that the springs and center bracket supporting the tube normally substantially medially thereof will just permit door clearance. This configuration, however, has serious limitations in that the cable binds the door to some extent due to the outward force applied during operation, and such is only effective to minimally reduce headroom clearance to a distance on the order of 12 inches; however, this expedient tends to increase the required clearance distance to the sides of the door frame.

Another approach to meeting low headroom requirements is a reversion to the use of one-piece door systems. These systems, which may or may not employ track systems, normally pivot the doors about a point approximately vertically medially of the door opening. One-piece door systems have not achieved a substantial acceptance due to one or more of a combination of disadvantages. These systems require assured clearance either inside or outside the door anytime it is opened or closed, depending on whether the door swings inwardly or outwardly, respectively. Normally these systems require additional side clearance to accommodate the pivoting mechanism and the counterbalance system. Finally, large one-piece doors are essentially prohibitive, and even small doors are highly disadvantageous in terms of packaging, shipping, transporting, and installing the doors.

A more drastic alternative to obtain additional headroom contemplates the movement of the entire counterbalance system to the rear of the horizontal track, i.e., inwardly of the garage to a position proximate the extremities of the horizontal track where the top of the door reposes when it is in the open position. In systems of this nature, it is necessary to route the cable by pulleys from the counterbalance system to the door frame and then to the door. Systems of this type have proven to be both inefficient and costly, while introducing a relatively large, unsightly mechanism centrally of a garage. In addition, such systems often result in a geometry such that the lower portion of the bottom panel of the door does not reach the lower edge of the header but rather hangs down a substantial distance into the door opening when in the horizontal, open position.

This hang-down characteristic is particularly critical in the case of below level garages where the driveway angles downwardly to the door, such that a vehicle is in an angular raised position when passing through the door opening.

Hang-down in existing door operations systems results from a combination of factors. Initially, a properly counterbalanced door has the spring tension approaching zero as the door moves from the closed to the open position and the weight of the door is progressively transferred from the cables of the counterbalance system to the horizontal section of the track system. Further, the guide roller proximate the bottom of the door is located above the bottom of the door and on the inside surface such that it is located in the curved transitional track section when the door is in the fully open position. The cable that is routed from the track system proximate the door opening is at a substantial increasing angle to the direction of travel of the door as the bottom roller moves increasingly into the curved transitional track section. Thus, in nearing the open position of the door, the force component operative to further open the door is reduced by the diminishing spring tension force and its increasing angle of application to the door. As a result, a substantial hang-down of doors into the door opening is common and may even require a door having a greater vertical height than would otherwise be required in some applications.

If a conventional counterbalance system is rear-mounted in a low headroom environment, a substantial portion of the system normally extends a distance below the horizontal track section. This configuration produces dangerous and thus undesirable conditions. First, the counterbalance springs are totally exposed to a person in the garage rather than being against the header where the door is between the springs and the person during most of the operating sequence. Second, persons of even average height may be exposed to the possibility of head injury and the irritation of interference with objects being carried in a garage having such an installation.

Rear-mounted counterbalance systems in low-overhead environments where it is necessary to maintain the horizontal track sections at the lowest possible height above the door header often experience difficulty in seating and locking the top door panel against the header in manually-operated door installations. In particular, linear or slightly curved tracks proximate the header may operate to effect closing and opening; however, in such installations even minimal forces, e g., wind, applied to the outside of the top panel can result in its unseating and uncontrolled opening. In many instances, prior-art systems have endeavored to solve low-overhead environments by displacing one or more components of the counterbalance system laterally outwardly of the tracks. However, in many instances, there are complexity and performance sacrifices created, and, in some instances, no solution is realized because low-headroom conditions are not infrequently accompanied by minimal side room to one or both sides of a door opening.

For example, the cable drums may be moved outside the track to preclude interference with the door; however, this is possible only where there is substantial clearance on both sides of a door and any adjacent wall or other obstruction. Other systems place the counterbalance drums inside of the rear ends of the horizontal track sections and route the cable over the horizontal track section and along the outside of the vertical track section to the bottom of the door. In these installations, the drum must be positioned above the track a sufficient distance to preclude the cables from abrading on the horizontal track sections, thereby requiring additional overhead clearance. In the instance of either of the above-described outside or inside drum mounting, the cable may interfere in the vertical cable run with photo eye sensors that are now required for radio-controlled motor-operated doors.

The aforedescribed conventional torsion spring counterbalancing systems also have the disadvantage that the weight of the spring members is such as to require the use of a support bracket which normally suspends the tubular shaft substantially medially between the drums. The stationary support bracket is also commonly employed as the stationary anchor for the torsion springs. The support bracket is attached to the door header or more commonly a special spring pad located on the garage wall thereabove. Since the stationary anchor associated with the support bracket undergoes torsional loading equal to the weight of the door, there is a constant potential for operational failure or damage and injury to installation and maintenance personnel. The torsional forces can also result in a loosening of the support bracket, loosening of the stationary spring anchor, a failure of a door opening header or spring pad, all of which can result in a quick and violent untensioning of torsion springs, thereby presenting the potential for damage or injury to any proximate objects. In the case of a conventional rearmount counterbalance system, the tensioning of conventional torsion springs in a low-headroom environment is very difficult because of the lack of clearance to manipulate the tensioning bars. Further, the center support bracket must be adequately supported in a cantilevered position due to the torsional loading imparted by the springs even at the expense of additional time or material.

Another disadvantage of such conventional torsion spring counterbalancing systems is the susceptibility to variations in balance of the door. With a drum diameter of approximately 4 inches, the drums revolve approximately seven times during an opening cycle of a 7-foot high door. As spring tension is lost through aging or extensive use, a highly noticeable variation in balance of the door is produced, as contrasted with systems which might have a lesser drum diameter and, therefore, rotate a greater number of times during opening and closing, such that the loading effect on a door is less for a given variation in spring tension. This same consideration makes it difficult to adjust the conventional 4-inch drum systems, since minute adjustments in spring tension can produce a substantial effect on a door.

DISCLOSURE OF THE INVENTION

Therefore, an object of the present invention is to provide a counterbalancing system for sectional doors which is highly compact and capable of being installed in relatively confined locations where there is a minimum of space surrounding the frame for a door opening. Another object of the present invention is to provide such a counterbalancing system which may be adapted for use with a variety of conventional sectional garage doors wherein the overhead clearance in the garage above the door opening is restricted. A further object of the present invention is to provide such a counterbalancing system, wherein the major components are substantially downsized in that elements such as the cable drums may be approximately one-half the diameter of the conventional drums normally employed in the industry on comparably sized doors.

Another object of the present invention is to provide a counterbalancing system for sectional doors in which the spring is mounted internally of the tubular shaft so as not to be outwardly exposed and subject to the environment and to provide for easier and faster replacement of broken springs. A further object of the present invention is to provide such a counterbalancing system wherein one extremity of each of the pair of springs employed is attached to gear shafts supported by brackets to either side of a door so that the torque of the springs is transmitted to the jamb structure outside the track and door opening for safety and accessibility. Yet another object of the present invention is to provide such a counterbalancing system wherein the center bracket, which may be mounted either on the top portion of the door jamb or a relatively vulnerable spring pad located on the garage wall, merely supports the weight of the drive tube springs and related components and does not experience torque loading.

Another object of the present invention is to provide a counterbalancing system for sectional garage doors wherein a pair of springs are employed, with each having one end thereof attached to spring perches which are axially freely movable within the spring tube and are thus free to adjustably float therein. A further object of the present invention is to provide such a counterbalancing system where the coils of the spring may be formed with a spacing which will accommodate a lengthening of the spring during tensioning while introducing only a minimum of frictional resistance. Still a further object of the present invention is to provide such a counterbalancing system wherein there is no necessity for set screws or drive pins, which can loosen or fail during operation, to transmit rotational forces between the springs and the other components directly or indirectly attached thereto. Still another object of the present invention is to provide such a counterbalancing system wherein the drive tube is mounted between the cable drums, with provision for sufficient clearance such that the drive tube floats to lessen frictional forces which might otherwise occur.

Still another object of the present invention is to provide a counterbalancing system for sectional doors wherein the length of the drive tube is equal to or less than the width of the door to be suspended such that the tube may be packaged in the same container as the door panels for ease of shipment and handling. Another object of the present invention is to provide such a counterbalancing system wherein the springs and worm gears are sized and configured such that they may be assembled at the time of manufacture, inserted into the drive tube, and shipped as an assembly. Still another object of the invention is to provide such a counterbalancing system which, in addition to its reduced size, may be of reduced weight, of reduced component size, of a reduced number of components, and an otherwise lower cost system. Still a further object of the present invention is to provide a counterbalancing system which is safe and easy to install, even without special tools, which is susceptible of adjustment to effect precise adjustments in spring tension operating on the door and is otherwise advantageous in terms of ease of assembly, operation, and repair.

Another object of the present invention is to provide an alternative arrangement for mounting a compact counterbalance system to achieve the capability of a door installation which can be installed in locations having a minimum of headroom and side room relative to the opening for a sectional overhead door. Yet another object of the present invention is to provide such a door system which may be installed in an environment where the available headroom from the ceiling or overhead to the top of the sectional door opening and the available side room requirement for clearance from the edge of the sectional door opening to proximate objects is, in both instances, less than three inches. Still a further object of the present invention is to provide such a door system wherein all components of the counterbalance system are accommodated substantially within the height of the horizontal section of the track system.

Still another object of the present invention is to provide a door system having a counterbalancing system mounted to the rear of the door in the open horizontal position proximate to the free ends of the horizontal track section, such that the primary components of the counterbalancing system may be located substantially co-planar with the roller at the upper extremity of top panel of the sectional door. A further object of the present invention is to provide such a door system wherein the upper roller at the top panel of the sectional door follows a substantially horizontal track section through the extent of its travel from the open horizontal position to the closed vertical position of the door. Yet a further object of the present invention is to provide such a door system wherein the upper roller of the top panel has a horizontal track section with a short inclined ramp proximate to the door header which seats and locks the top panel of the sectional door in place without the need for a motor-driven operator.

Yet another object of the present invention is to provide a door system having a rear-mounted counterbalance system wherein no portion of the counterbalance system extends below the horizontal track section such as to provide a safe environment for persons in proximity despite a low headroom condition. Still a further object of the invention is to provide such a door system wherein the top of the sectional door never extends above the top of the horizontal track sections. Yet another object of the invention is to provide such a door system employing the compact counterbalance system which transmits torque to the tracks in an area proximate to the supported free ends thereof, such that the cantilevered center support for the counterbalance system is not subjected to torque-loading from the springs of the counterbalance system.

A still further object of the present invention is to provide a door system which employs a counterbalancing system which when mounted to the rear of the horizontal tracks maintains all of the operational advantages achieved with conventional jamb mounting. A still further object of the present invention is to provide such a door system which achieves a highly compact configuration with the hang-down of the bottom of the lower panel of the door being minimized by judicious placement of the pulley supporting the counterbalance system cables extending between the cable drums and a bracket at the lower extremity of the bottom panel of the door.

Yet another object of the present invention is to provide a compact track and counterbalance system for sectional doors wherein the sectional door, door components, and the counterbalance system fit within the area defined by the compact track system when the door is in the open, horizontal position. A further object of the present invention is to provide such a compact track and counterbalance system employing a rear-mounted counterbalance system in which no components of the counterbalance system extend below the horizontal track section, and the cable does not extend into the garage in the area of the curved transitional track section, all for purposes of safety considerations. A further object of the invention is to provide such a compact track and counterbalance system which has both minimum overhead clearance and side clearance, such that a single system may be manufactured and inventoried for all applications where there are either stringent overhead or side clearance restrictions.

Another object of the present invention is to provide a compact track and counterbalance system for sectional doors wherein each horizontal track section consists of upper and lower horizontal track sections, and each vertical track section consists of an outer vertical track section and an inner vertical track section. Yet another object of the present invention is to provide such a compact track and counterbalance system wherein the lower horizontal track section and the inner vertical track section are connected by a curved transition track section engaged by the intermediate rollers on the sectional door to permit usage of standard graduation hinges which cooperate with a vertical track section angled with respect to a door frame at approximately ⅛ inch per foot of door height, such as to move the door sections away from the jamb or jamb seal during the opening of the sectional door and move the sections toward the jamb or jamb seal as the door closes. Another object of the present invention is to provide such a compact track and counterbalance system wherein the top roller of the sectional door engages the upper horizontal track section that has an auxiliary track section which positively positions the top panel of the door in place against the door jamb when the door is in the closed position and prevents displacement of the top panel due to wind or forced entry efforts without the necessity for use of a motor-driven operator attached to the top panel.

Yet another object of the present invention is to provide such a compact track and counterbalance system wherein the bottom roller of the sectional door is positioned below the bottom of the sectional door and moves in the outer vertical track section, which is substantially vertically oriented so that the bottom roller moves vertically upwardly a sufficient distance, whereby the bottom panel of the sectional door moves vertically upward into the plane of the horizontal track section when the door is open, thereby exhibiting a mininimum of hang-down of the bottom door panel into the door opening. Yet another object of the present invention is to provide such a compact track and counterbalance system wherein the track and door rollers are geometrically arranged, such that the top panel of the door never extends above the horizontal track section, which can thus be positioned in close proximity to the ceiling or other overhead obstructions in a garage.

Another object of the present invention is to provide a compact track and counterbalance system for sectional doors wherein the cross-sectional height of each individual track section is approximately one-half the cross-sectional height of conventional track sections, such that dual or upper and lower horizontal track sections may be located in substantially the same space as a single conventional track section. Still a further object of the present invention is to provide such a compact track and counterbalance system wherein an inside hook-up of the cable to the bottom of the door is provided, together with space for the cable or cables to pass within the confines of the track system through its entire travel proximate the horizontal track section and the vertical track section without interfering with the track or the guide rollers for the sectional door. A further object of the present invention is to provide a compact track and counterbalance system for sectional doors which with an outer vertical track section having a minimally curved upper vertical extremity may employ a conventional cable system in conjunction with a conventional counterbalance system and drum.

In general, the present invention contemplates an overhead door system including a sectional door having top, bottom, and intermediate panels hinged for moving between a closed vertical position and an open horizontal position, top rollers on the top panel, bottom rollers on the bottom panel, intermediate rollers positioned between the top rollers and the bottom rollers, inner vertical tracks for engaging the intermediate rollers, transition tracks commencing at the upper extremity of the inner vertical tracks curving through an angle of approximately ninety degrees for directing the travel of the intermediate rollers, horizontal tracks extending from the transition tracks for engaging the intermediate rollers to support the door in the open horizontal position, and outer vertical tracks for guiding the bottom rollers in a substantially vertical path when moving between the open horizontal position and the closed vertical position.

PREFERRED EMBODIMENT FOR CARRYING OUT THE INVENTION

Figure 1:
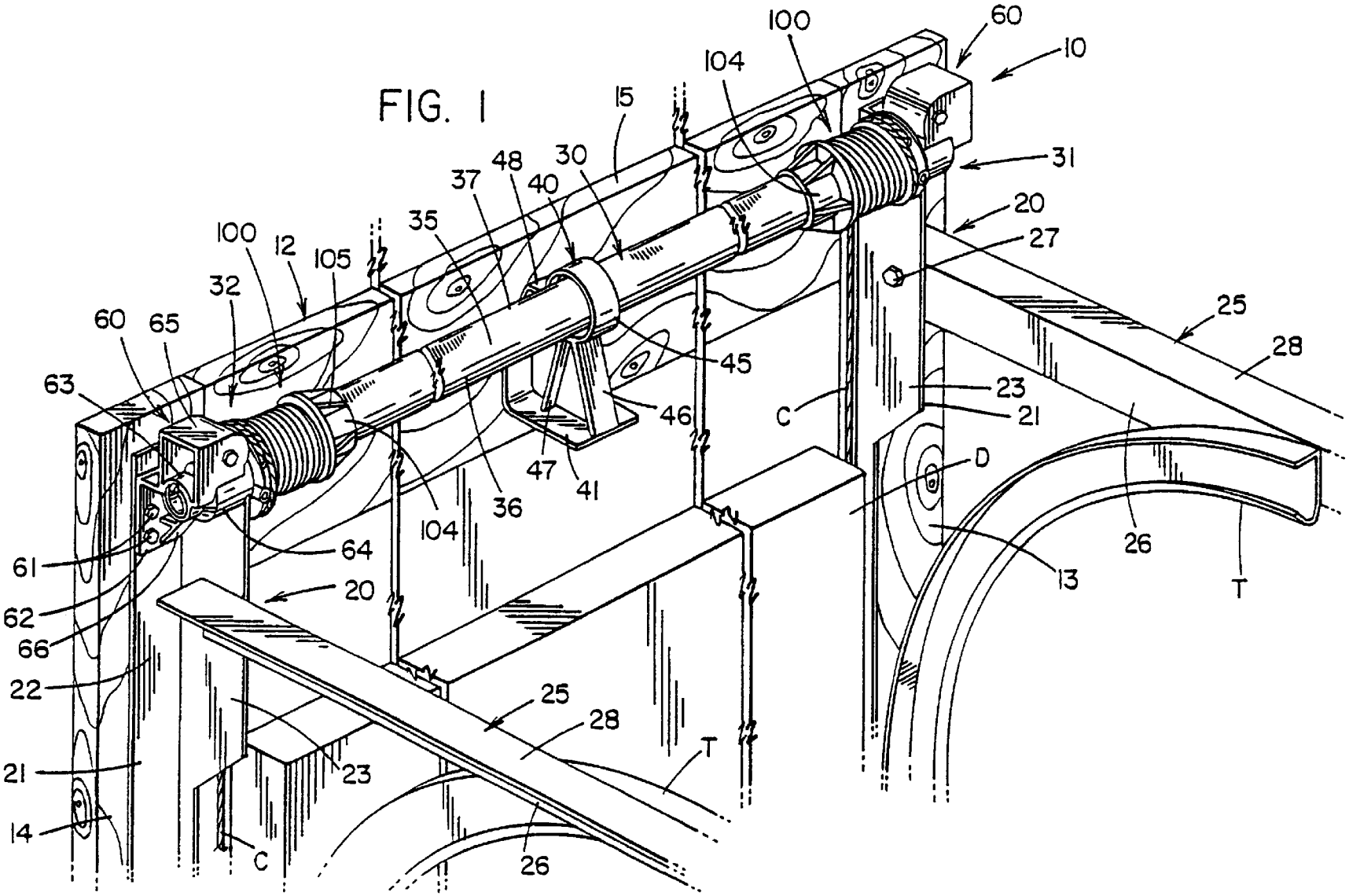
FIG. 1 is a fragmentary perspective view depicting a frame for a sectional door and showing a counterbalancing system embodying the concepts of the present invention as mounted in operative relationship to the door.

A counterbalancing system according to the concepts of the present invention is generally indicated by the numeral 10 in FIG. 1 of the drawings. The counterbalancing system 10 is shown mounted in conjunction with a conventional sectional door D of the type commonly employed in garages for homes. The opening in which the door is positioned for opening and closing movements relative thereto is surrounded by a frame, generally indicated by the numeral 12, which consists of a pair of spaced jamb members 13 and 14 that, as seen in FIG. 1, are generally parallel and extend vertically upwardly from the ground (not shown). The jambs 13, 14 are spaced and joined at their vertically upper extremity by a header 15 to thereby delineate a generally U-shaped frame 12 around the opening for a door D. The frame 12 is normally constructed of lumber, as is well known to persons skilled in the art, for purposes of reinforcement and to facilitate the attachment of elements supporting and controlling a door D, including the counterbalancing system 10.

Affixed to the jambs 13, 14 proximate the upper extremities thereof near the header 15 to either side of the door D are flag angles, generally indicated by the numeral 20. The flag angles 20, which may be of differing configurations, generally consist of L-shaped vertical members 21 having a leg 22 attached to an underlying jamb 13, 14 and a projecting leg 23 preferably disposed substantially perpendicular to the leg 22 and therefor perpendicular to the jambs 13, 14.

The flag angles 20 also include an angle iron 25 having a vertical leg 26, which may be attached to the projecting legs 23 of the vertical members 21 as by bolts 27. The angle irons 25 have stiffening legs 28. The angle irons 25 are positioned in supporting relation to the tracks T located to either side of a door D. The tracks T, T provide a guide system for rollers attached to the side of a door D, as is well known to persons skilled in the art. The angle irons 25 preferably extend substantially perpendicular to the jambs 13, 14 and may be attached to the transitional portion of tracks T, T between the vertical portion and horizontal portion thereof or in the horizontal portions of tracks T, T. The tracks T, as is well known, thus define the travel of the door D in moving from the open to closed positions and support a portion of the weight of the door D in the vertical and transition sections and substantially the entirety of the weight of the door in the horizontal sections.

The counterbalancing system 10 is positioned at or above the header 15. The counterbalancing system 10 includes an elongate drive tube, generally indicated by the numeral 30, extending between a tensioning assembly 31 and a tensioning assembly 32, which are positioned proximate the right side flag angle 20 and the left side flag angle 20, respectively.

Figure 5:
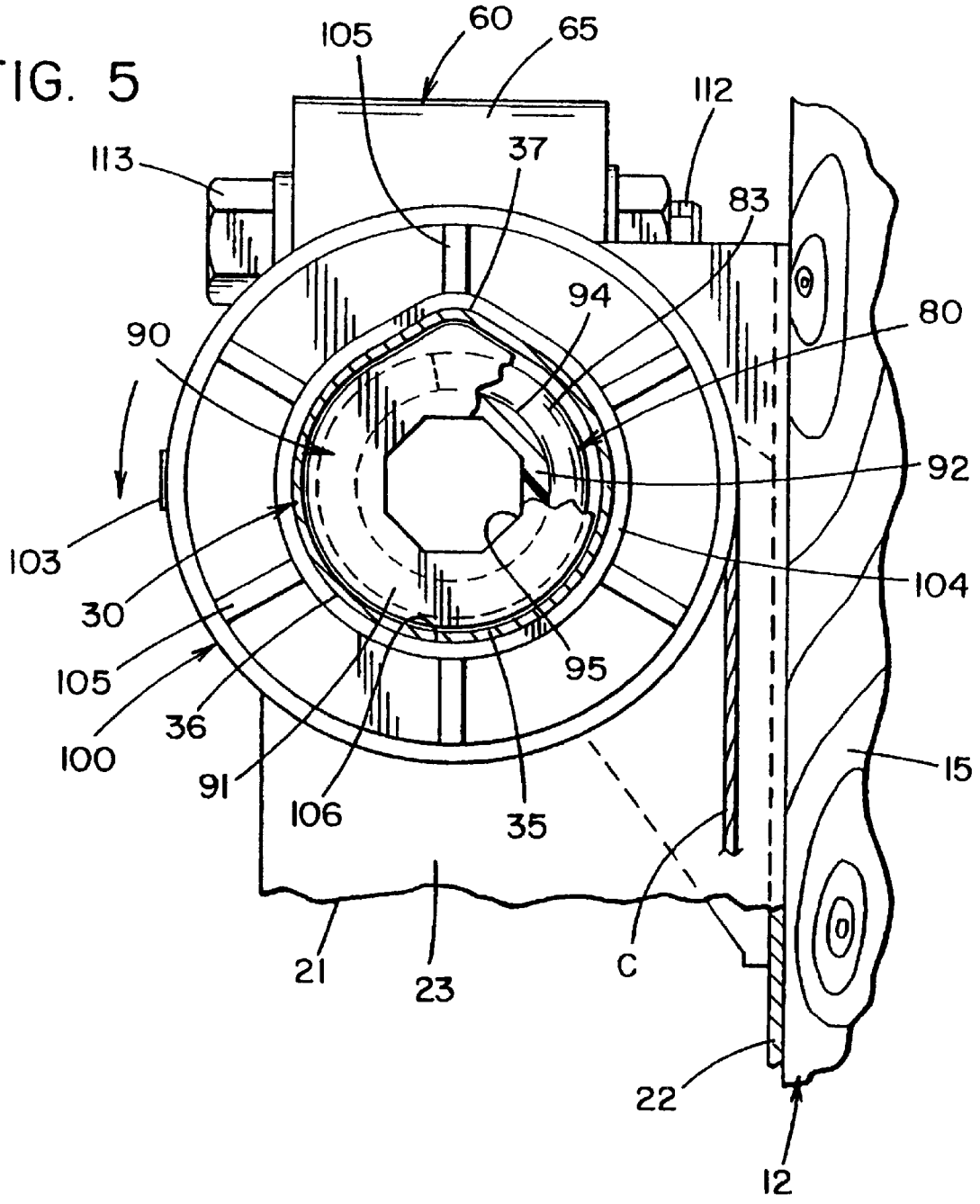
FIG. 5 is a cross-sectional view taken substantially along the line 5—5 of FIG. 4 and showing particularly the interrelation between the drive tube and the cable drum assembly.

The drive tube 30 is a hollow tubular member which is non-circular in cross section, as best seen in FIGS. 1 and 5. In the preferred form, the tubular member 35 has a circular portion 36 constituting a substantial portion of the circumference of tubular member 35. The remainder of tubular member 35 consists of a radially projecting cam lobe 37 which preferably extends axially the full length of the tubular member 35. The cam lobe 37 is configured such that the radial distance from the center of tubular member 35 to the radially outermost point of the cam lobe 37 is equal to or greater than the distance to the intersection of two sides of a eight or more sided polygon which might be circumscribed about a circle of the size of the circular portion 36 of tubular member 35. Alternatively, the tubular member 35 could be a polygon with less than seven sides. These exemplary configurations provide examples of a noncircular tubular member 35, such that internally or externally mating members cannot rotate relative to tubular member 35, as hereinafter described under the operating conditions encountered in use of the counterbalancing system 10.

Figure 2:
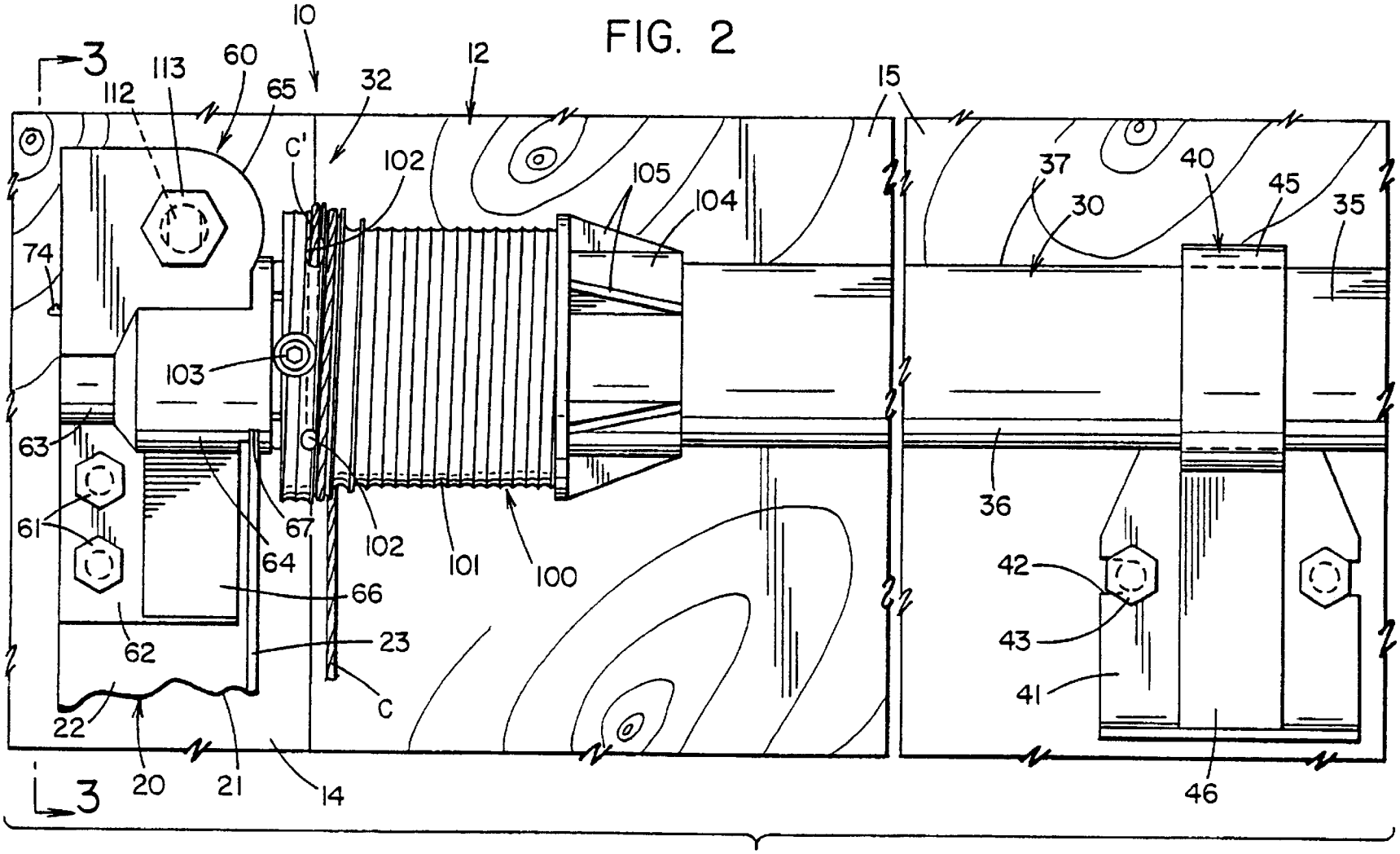
FIG. 2 is a fragmentary elevational view of the left-hand portion of the counterbalancing system of FIG. 1 as viewed from the inside of the sectional door.
Figure 4:
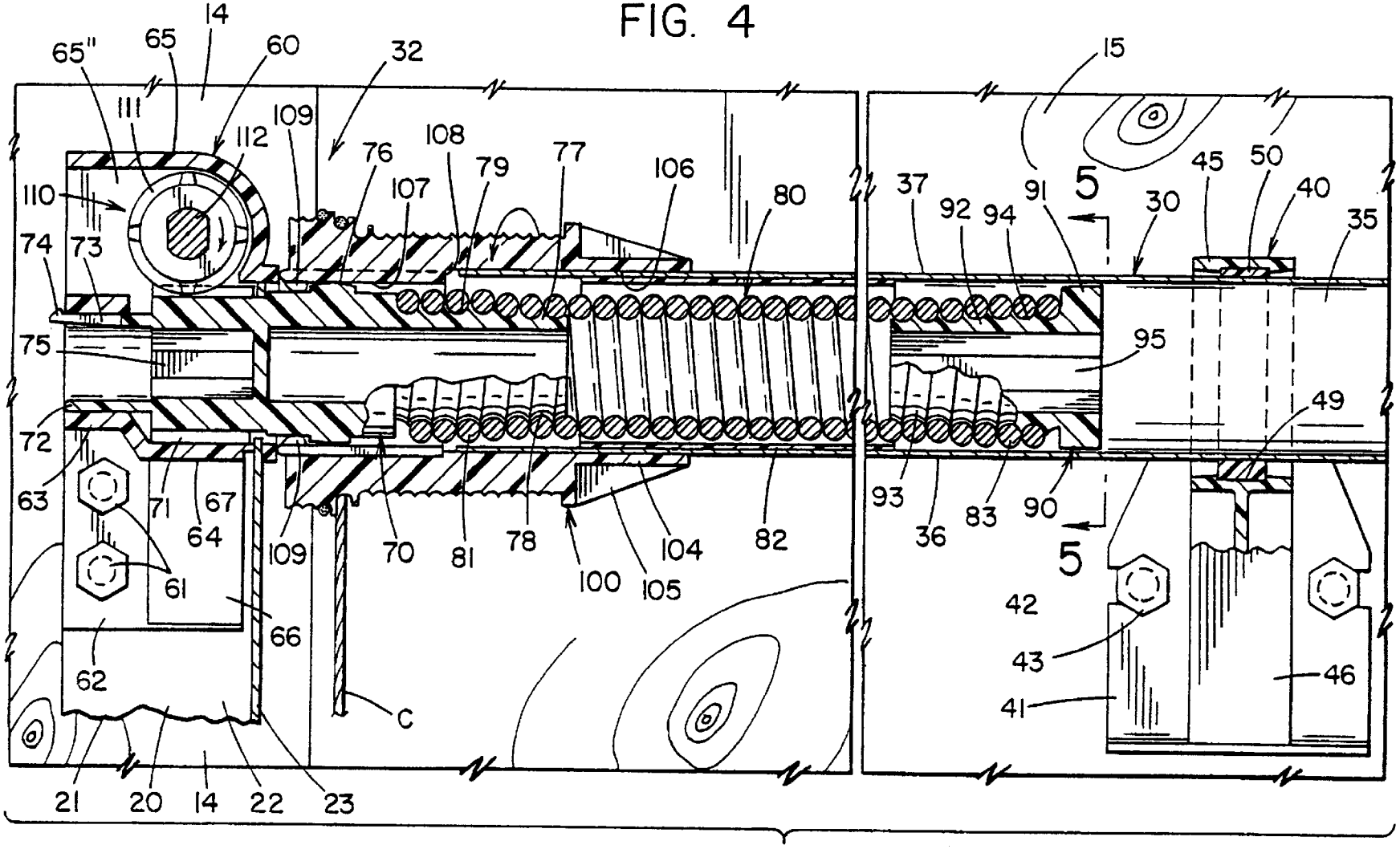
FIG. 4 is a cross-sectional view taken substantially along the line 4—4 of FIG. 3 and showing particularly details of the spring, the drive tube, the worm gear shaft, and the spring perch.

Depending upon the width of door D, the drive tube 30 may advantageously be supported substantially medially of its length by a center bracket, generally indicated by the numeral 40, as seen in FIGS. 1, 2, and 4 of the drawings. The center bracket 40 includes an L-shaped attachment plate 41 which may be provided with slots 42 or bores for receiving screws 43 to anchor the center bracket 40 to the header 15 or, depending upon the installation, a mounting pad affixed to the garage wall above the header 15.

The center bracket 40 has an annular journal box 45 which is spaced from and supported by attachment plate 41 by a plurality of struts 46, 47, and 48, which are preferably oriented substantially radially of annular journal box 45 (FIG. 1). The annular journal box 45 has a radial recess 49 positioned preferably substantially axially medially thereof. The recess 49 seats a bushing 50 which is affixed to the tubular member 35 of drive tube 30 (FIG. 4). The bushing 50 is interiorly contoured to the configuration to the tubular member 35, including the lobe 37, and externally circular to freely rotatably move within the recess 49 of the annular journal box 45.

The drive tube 30 interconnects at the ends thereof spaced from the center bracket 40 with the tensioning assemblies 31 and 32. Since the tensioning assemblies 31 and 32 are essentially identical, except that most components are symmetrically opposite, and since they function identically, only the tensioning assembly 32 is hereinafter described, as depicted in FIGS. 2–6 of the drawings.

Figure 3:
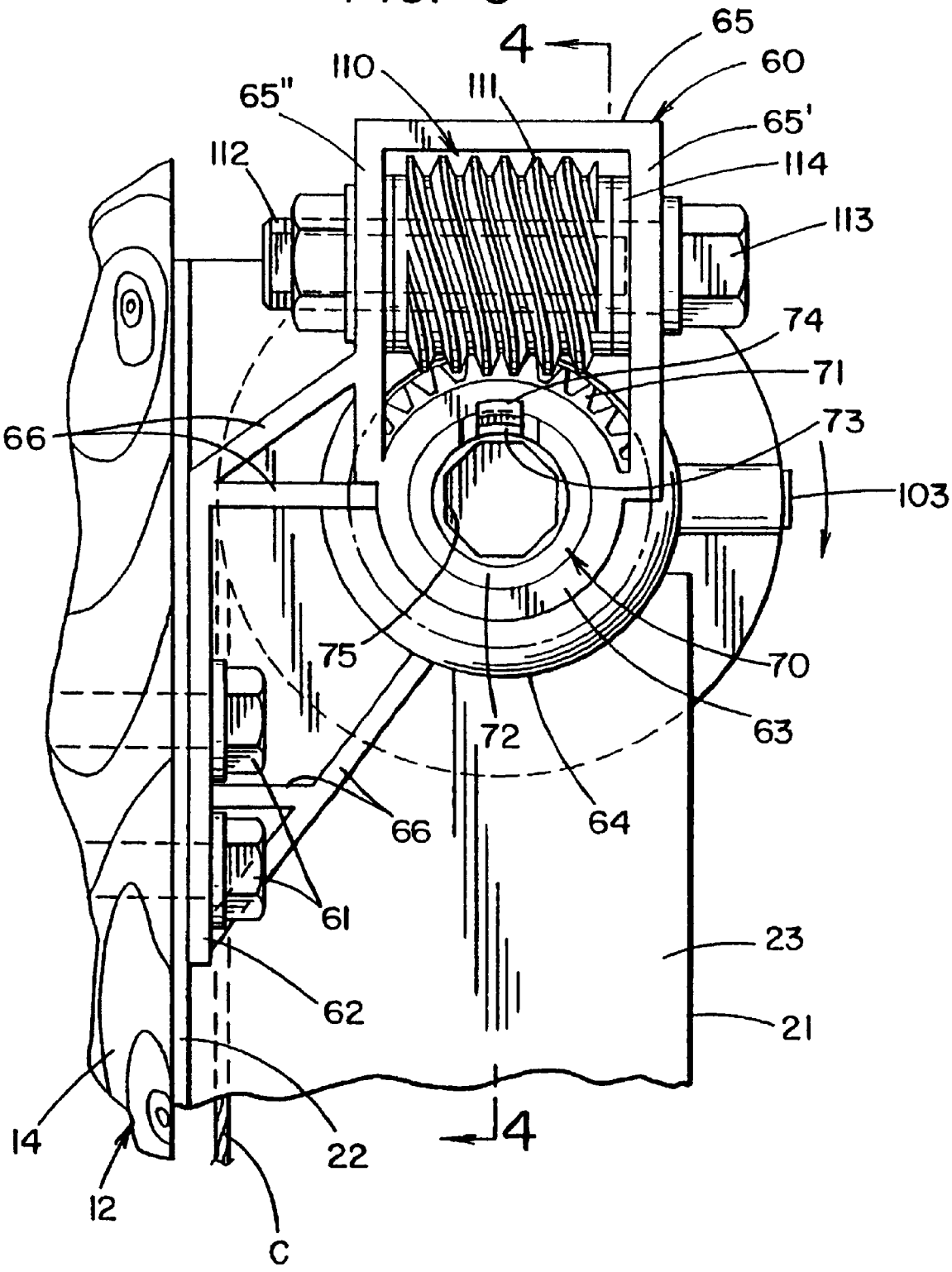
FIG. 3 is a side elevational view of the counterbalancing system taken substantially along the line 3—3 of FIG. 2 and depicting particularly the mounting bracket and its interrelation with the sectional door frame, together with the worm drive assembly for adjusting the tensioning assembly.

The tensioning assembly 32 has an end bracket, generally indicated by the numeral 60, to effect attachment to the flag angle 20 and/or the jamb 14 as by bolts 61 which extend through a backing plate 62 of the end bracket 60 (see FIG. 3). The end bracket 60 includes a tubular bearing box 63, a gear housing 64, and a worm shroud 65. As best seen in FIGS. 1 and 3, the worm shroud 65 may be a generally U-shaped enclosed member having spaced legs 65' and 65" (FIG. 3) for a purpose to be hereinafter detailed. The tubular bearing box 63, gear housing 64, and worm shroud 65 are spaced and supported a distance from the plate 62 by a plurality of braces 66 (FIG. 3). The end bracket 60 may conveniently be provided with a slot 67 to receive the projecting leg 23 of flag angle 20. This serves to align and support the assembled counterbalancing system 10 while bolts 61 are installed to effect permanent placement.

The tensioning assembly 32 includes a gear shaft, generally indicated by the numeral 70, which interfits with the end bracket 60. The gear shaft 70 has a worm gear 71 formed therein which is positioned within the gear housing 64 of end bracket 60 (FIGS. 3 and 4). Extending axially in one direction from the worm gear 71 is a hollow sleeve 72, which is supported within the tubular bearing box 63 of end bracket 60. The sleeve 72 may terminate in one or more snap locks 73, which extend axially outwardly of and have a radially projecting lip 74 that overlies a portion of the axially outward surface of tubular bearing box 63 of end bracket 60. It will thus be appreciated that the end bracket 60 may be readily attached to the gear shaft 70 during installation of counterbalancing system 10 and particularly during the placement and attachment of the end bracket 60 to the jamb 14.

Radially inwardly of the worm gear 71 and accessible through the hollow sleeve 72, the gear shaft 70 may have a bore 75 which may be of octagonal configuration to receive a comparably shaped tool to facilitate gripping of the gear shaft 70 to permit assembly and disassembly of the counterbalancing system 10 in a manner described hereinafter.

The gear shaft 70 has spaced a distance axially of the worm gear 71 in the direction opposite the sleeve 72 a radially upstanding bearing surface 76. The bearing surface 76 serves a purpose to be described hereinafter.

The gear shaft 70 at the end opposite the sleeve 72 terminates in a spring receiver portion 77. The spring receiver portion 77 consists of a plurality of helical grooves 78 which may be formed at substantially the same pitch angle and diameter as the coil spring, generally indicated by the numeral 80, which reposes thereon. If desired, a number of helical grooves 79 may be of a slightly larger diameter in the area displaced from the end of gear shaft 70 to further facilitate the tension of the spring 80 thereon.

The coil spring 80 may be of uniform configuration from end to end and have a spacing between the coils of several hundredths of an inch for purposes of accommodating additional coils of the spring 80 which are present in the working area of the spring 80 when it is subjected to torsional loading as hereinafter described. The spring 80 has a spring end 81, which is mounted in the grooves 78, 79 of the spring receiver portion 77 of gear shaft 70. The spring end 81 may be threaded on receiver 77 with an appropriate tool inserted into the bore 75 to prevent rotation of gear shaft 70 during assembly and disassembly operations.

A spring liner 82 may be provided radially outwardly of the spring 80 in the working area of the spring 80, as seen in FIG. 4. The spring liner 82 may conveniently be positioned on the interior surface of the tubular member 35 of drive tube 30 and may be shaped to the internal configuration thereof. The spring liner 82 may be of any impact-resistant plastic material for purposes of damping possible spring chatter which may develop during rapid torsional loading or unloading of the spring 80.

Figure 6:
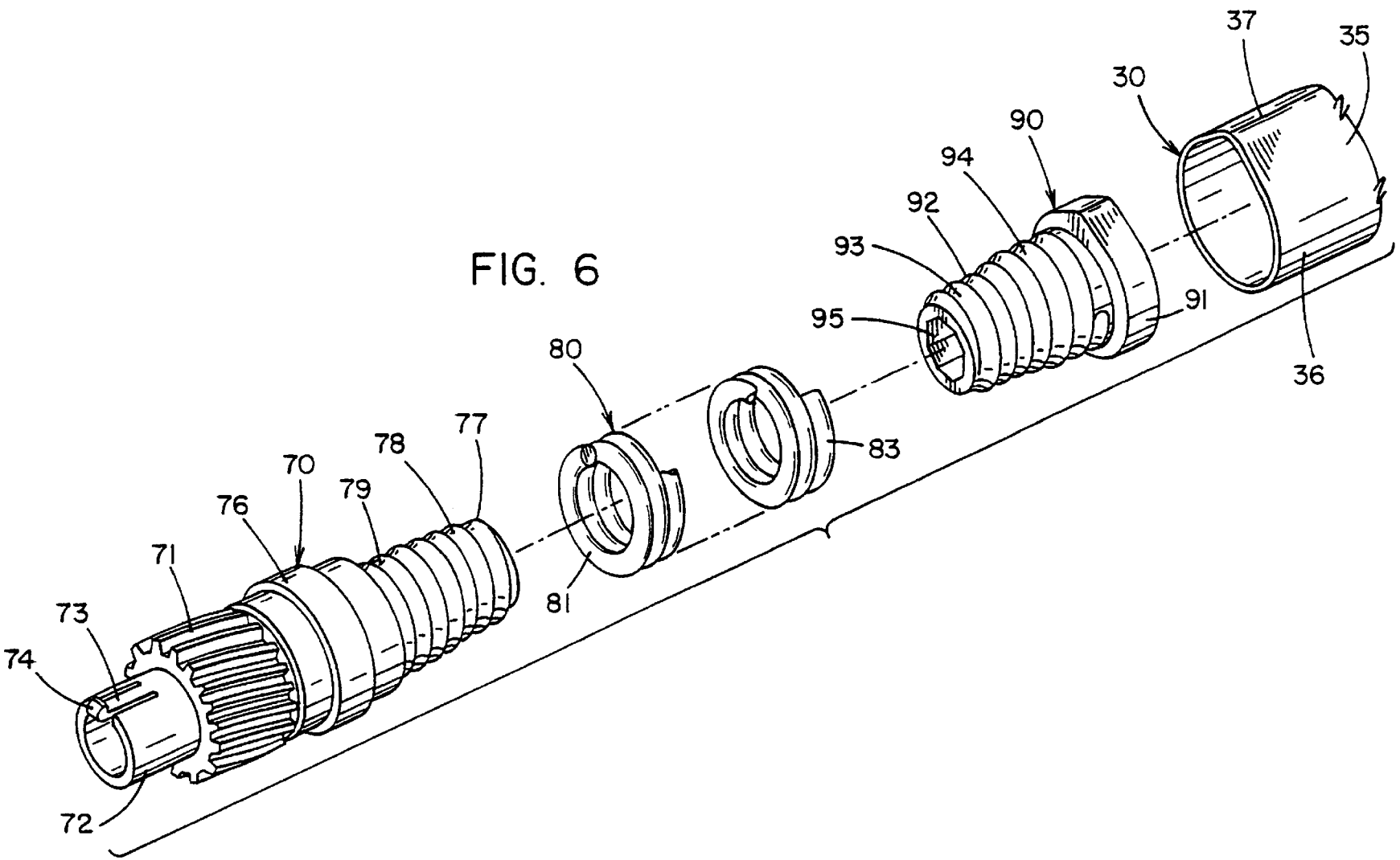
FIG. 6 is an exploded perspective view showing details of the worm gear shaft, the spring, the spring perch, the drive tube, and the interrelation therebetween.

Spring 80 has a spring end 83 at the opposite axial extremity from spring end 81 which engages a spring perch, generally indicated by the numeral 90. The spring perch 90 has a body portion 91 which, as seen in FIGS. 4 and 6, is externally configured for matingly engaging the inner surface of tubular member 35. The spring perch 90 has a spring receiver portion 92 which extends axially from the body 91. The spring receiver 92 may be formed in a manner comparable to spring receiver 77 and having a plurality of helical grooves 93 and a plurality of helical grooves 94, which are of a slightly greater diameter than the grooves 93, to similarly facilitate retention of spring end 83 when positioned thereon, as depicted in FIG. 4. The spring perch 90 may have a bore 95 of octagonal cross section similar to the bore 75 of gear shaft 70, again for the purposes of facilitating non-rotational retention of spring perch 90 during the assembly and disassembly of spring end 83 thereon.

It will thus be appreciated that the spring perch 90, due to the configuration of the body 91, remains non-rotatably positioned relative to and within the drive tube 30, while being capable of floating or moving axially within drive tube 30 when the spring 80 is not under torsional loading. This permits the spring perch 90 to self-adjust axially of the drive tube 30 to accommodate the exact length of a coil spring 80.

The drive tube 30 carries at the extremity thereof proximate to the end bracket 60 and supported in part by worm shaft 70 a cable drum mechanism, generally indicated by the numeral 100. Referring particularly to FIGS. 2, 4, and 5, the cable drum mechanism 100 has an external surface over a substantial portion of its length consisting of a continuous helical grooves 101. The helical grooves are adapted for reeving a suspension cable C thereabout. The cable C is attached at one end to a point on the door at substantially the bottom of the lowermost panel when a door D is in the closed position. The other end C' of the cable C is affixed to the cable drum 100 for selective retention and release when a cable C is installed or replaced. In this respect, an angular bore 102 extends into the drum 100 preferably proximate one extremity of the helical grooves 101 and is sized to receive the cable C. A hex screw 103 is positioned in a tapped radial bore (not shown) which intersects with the bore 102. Thus, the hex screw 103 may be tightened to retentively engage end C' of cable C and released by loosening the hex screw 103 to move end C' of cable C from the bore 102. The end of cable drum 100 axially opposite the hex screw 103 has a projecting sleeve 104 which may be provided with a plurality of circumferentially spaced reinforcing ribs 105.

The cable drum 100 has a central bore 106 extending through the sleeve 104 and preferably a substantial distance into the drum 100, which is configured to matingly engage the exterior surface of the tubular member 35 of drive tube 30. It will thus be appreciated that the cable drum 100 is non-rotatably affixed to, and therefore at all times rotates with, the drive tube 30. The axial end of cable drum 100 opposite the bore 106 has a bore 107 of lesser diameter which is adapted to matingly engage and ride upon the projecting bearing surface 76 of gear shaft 70. An extent of clearance may be provided between a shoulder 108 formed by the juncture of bores 106 and 107 and the extremity of the drive tube 30 at either end thereof, such that the drive tube 30 is capable of an extent of axial movement to avoid possible binding or frictional interference (FIG. 4).

The bore 107 of cable drum 100 may be provided with a plurality of circumferentially-spaced radially inwardly projecting teeth 109. The teeth 109 extend inwardly of the bearing surface 76 of gear shaft 70 for purposes of positioning cable drum 100 axially of gear shaft 70 during assembly and installation.

It will thus be appreciated by persons skilled in the art that the counterbalancing system 10, as depicted in FIGS. 1, 2, and 4, is shown in a position with the door in substantially the closed position and the spring 80 thus fully tensioned to apply counterbalancing forces to a door D. As a door D would be raised manually or by a powered operator (not shown), the spring 80 having one end fixed by the gear shaft 70 would rotate the spring perch 90 and thus the drive tube 30 which rotates the cable drum mechanism 100 to reeve the cable C onto the groove 101. The spring 80 is thus progressively untensioned as the door D moves upwardly into the open position. Subsequent lowering of the door D operates in a reverse fashion to progressively load spring 80 as the door D is lowered, such that the counterbalancing system 10 reaches substantially the configuration depicted in FIGS. 1, 2, and 4.

The spring 80 is non-rotatably restrained and suitably pretensioned by a tension adjusting mechanism, generally indicated by the numeral 110 in FIGS. 3 and 4 of the drawings. The tension adjusting mechanism 110 is enclosed within the worm shroud 65 of end bracket 60 for purposes of protection from dirt or foreign objects, safety, and appearance. The tension adjusting mechanism 110 includes a worm 111 of relatively short axial extent which engages the worm gear 71 of gear shaft 70. The worm 111 is mounted on a worm shaft 112 which extends through the spaced legs 65', 65" of the worm shroud 65 of end bracket 60 for positioning the worm 111 in operative relation to the worm gear 71.

The tension adjusting mechanism 110 and worm gear 71 are designed and configured such that the worm mechanism can be operated only by actuation of the head 113 of non-circular worm shaft 112 which rotates the worm 111. Worm 111 and worm gear 71 are designed in such a fashion that the worm gear 71 cannot rotate the worm 111 in the operating range of the counterbalancing system 10. This is effected in part by employing a lead angle on worm 111 and worm gear 71 to provide increased friction, thus decreasing the operating efficiency thereof. A lead angle of approximately 11 to 14 degrees has been found to be sufficient to meet these operating parameters for systems involving doors in the size range herein contemplated. If desired in particular installations, a fiber washer 114 may be positioned proximate the worm 111 to provide additional friction and increase anti-reversing friction to assure that worm gear 71 does not drive worm 111 under any operating circumstances. It will be appreciated that the rotational position of gear shaft 70 remains fixed at all times during operation of the counterbalancing system 10, except when the head 113 of worm shaft 112 is rotated. It will be further appreciated that tensioning adjustments may be readily made by using a conventional hex socket and drill to rotate the head 113 in the desired direction to effect a selected pretensioning of the spring 80.

Thus, it should be evident that the counterbalancing system 10 for a sectional door D disclosed herein carries out various of the objects of the present invention set forth above and otherwise constitutes an advantageous contribution to the art. As will be apparent to persons skilled in the art, modifications can be made to the preferred embodiments disclosed herein without departing from the spirit of the invention. For example, it will be appreciated that only one of the tensioning assemblies 31, 32 might be employed, as with only an end bracket 60, gear shaft 70, and cable drum 100 being provided at one end, to supply the entirety of the torsional forces for the counterbalancing system 10.

Figure 7:
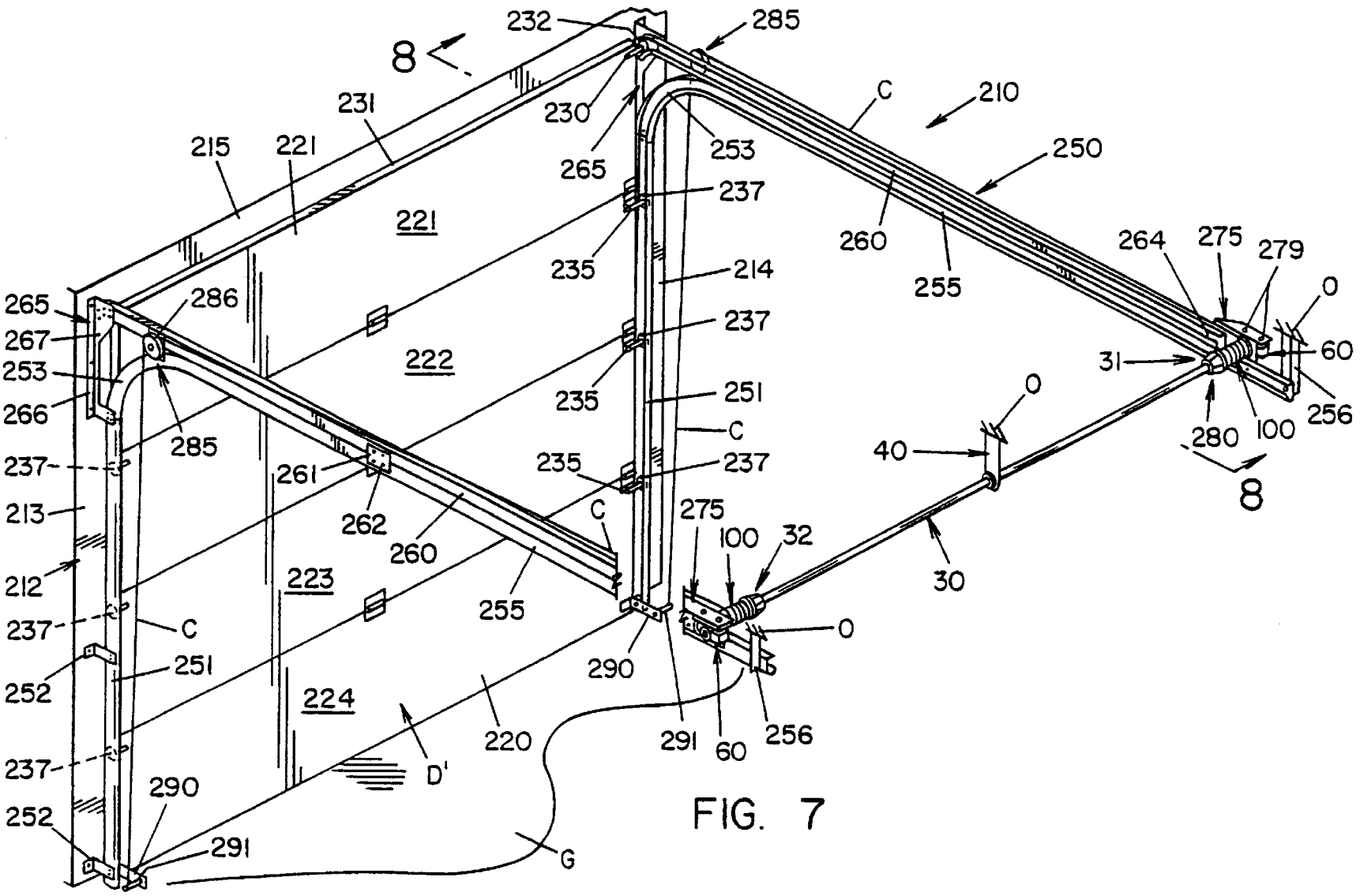
FIG. 7 is a fragmentary, perspective view with portions broken away of an alternative arrangement for mounting the counterbalancing system of FIGS. 1–6 at the rear of the horizontal tracks, as viewed in relation to the inside of a sectional door.
Figure 8:
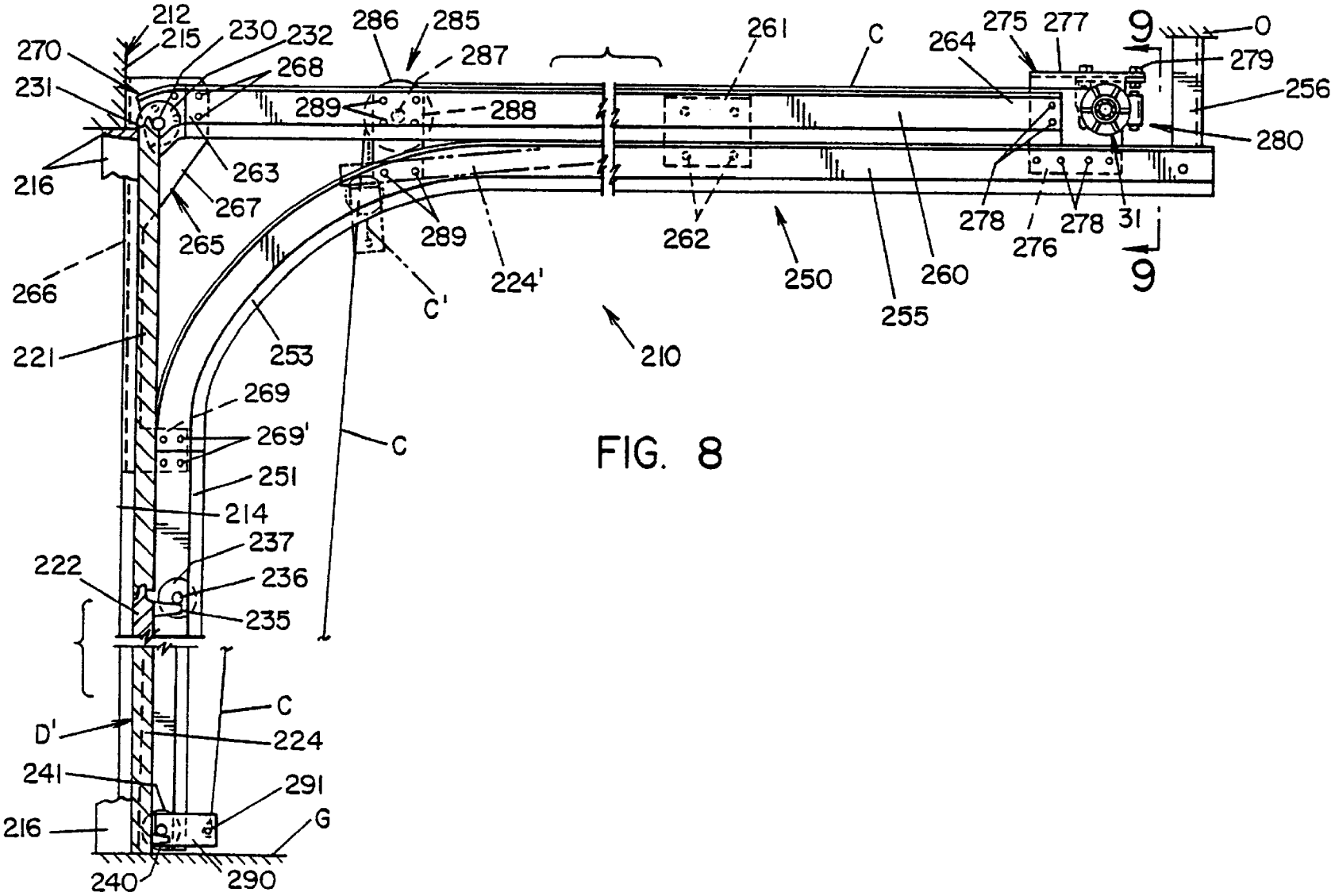
FIG. 8 is a fragmentary, side-elevational view taken substantially along the line 8—8 of FIG. 7 of one side of the track and counterbalancing system of the alternative arrangement for mounting the counterbalancing system showing details of the dual horizontal tracks and the counterbalancing system.

An alternate arrangement for employing the counterbalance system 10 is shown in the form of the overhead door mounting system, generally indicated by the numeral 210, in FIGS. 7 and 8. The door mounting system 210 is shown in relation to a conventional sectional door D' of the type commonly employed in residential garages, utility buildings, and the like. The opening in relation to which the door is positioned for opening and closing movements is surrounded by a door frame, generally indicated by the numeral 212, which consists of a pair of spaced jamb members 213 and 214 that are generally parallel and extend vertically upwardly from the garage floor or ground G. The jambs 213, 214 are spaced and joined at their vertically upper extremity by a header 215 to thereby form a generally U-shaped frame 212 around the opening for the door D'. A peripheral molding 216 may overlie and extend inwardly of the frame 212 to form a co-planar door engaging surface. The frame 212 may be conventionally constructed, as indicated hereinabove, in conjunction with the frame 12.

As seen in FIGS. 7 and 8, the sectional door D' consists of a rectangular arrangement of panels 220, including a top panel 221, an adjacent upper middle panel 222, an adjacent lower middle panel 223, and an adjacent bottom panel 224. The top panel 221 has top brackets 230 positioned at either side near the top edge 231, each of which mounts an upper roller 232 that is offset from door D' a slight distance. As best seen in FIG. 8, hinge brackets 235 having pivot pins 236 and rollers 237 are positioned proximate the juncture of panels 221 and 222, the juncture of panels 222 and 223, and the juncture of panels 223 and 224 at either side of door D'. The brackets 235 may have vertically progressively greater offsets of the rollers 237 with respect to the door panels to assist in bringing the door downward and progressively into contact with the peripheral molding 216 of jamb brackets 213, 214 in a manner well known in the art. A bottom bracket 240 positions a bottom roller 241 proximate the lower edge of the bottom panel 224, as best seen in FIG. 8.

Referring still to FIGS. 7 and 8, the door mounting system 210 has the door D' movably interrelated with the frame 212 by a track system, generally indicated by the numeral 250. The track system 250 has vertical track sections 251 to either side of the door D' extending from the ground G constituting the floor of a garage or other structure to a position somewhat below the header 215 of the frame 212. The vertical track sections 251 are positioned laterally of and vertically with respect to jambs 213 and 214 as by a plurality of conventional jamb brackets 252 (see FIG. 7). The vertical track sections 251 are connected to curved transition track sections 253, which may be an involute transcending through approximately ninety degrees and terminating in a substantially horizontal orientation at a height substantially in vertical alignment with the top edge 231 of top panel 221 of door D' in the closed vertical position, as best seen in FIG. 8. The transition track sections 253 merge into or are connected to lower horizontal track sections 255 which extend rearwardly from, and are substantially perpendicular to, frame 212. The lower horizontal track sections 255 are supported proximate their rearward extremity by struts 256 which may be attached to the overhead O thereabove in a conventional fashion well known in the art.

The track system 250 differs in significant respect from conventional track systems in having upper auxiliary horizontal track sections 260. As shown, the upper auxiliary horizontal track sections 260 are substantially parallel with, are in substantially vertical alignment with, and are preferably in abutting longitudinal engagement with the lower horizontal track sections 255. Optionally, the track sections 255 and 260 may be welded along their entire abutting surfaces to impart additional strength and rigidity thereto. If desired, one or more reinforcing plates 261 may be attached to both of the adjacent track sections 255 and 260 as by welds 262 for further strengthening.

Figure 10:
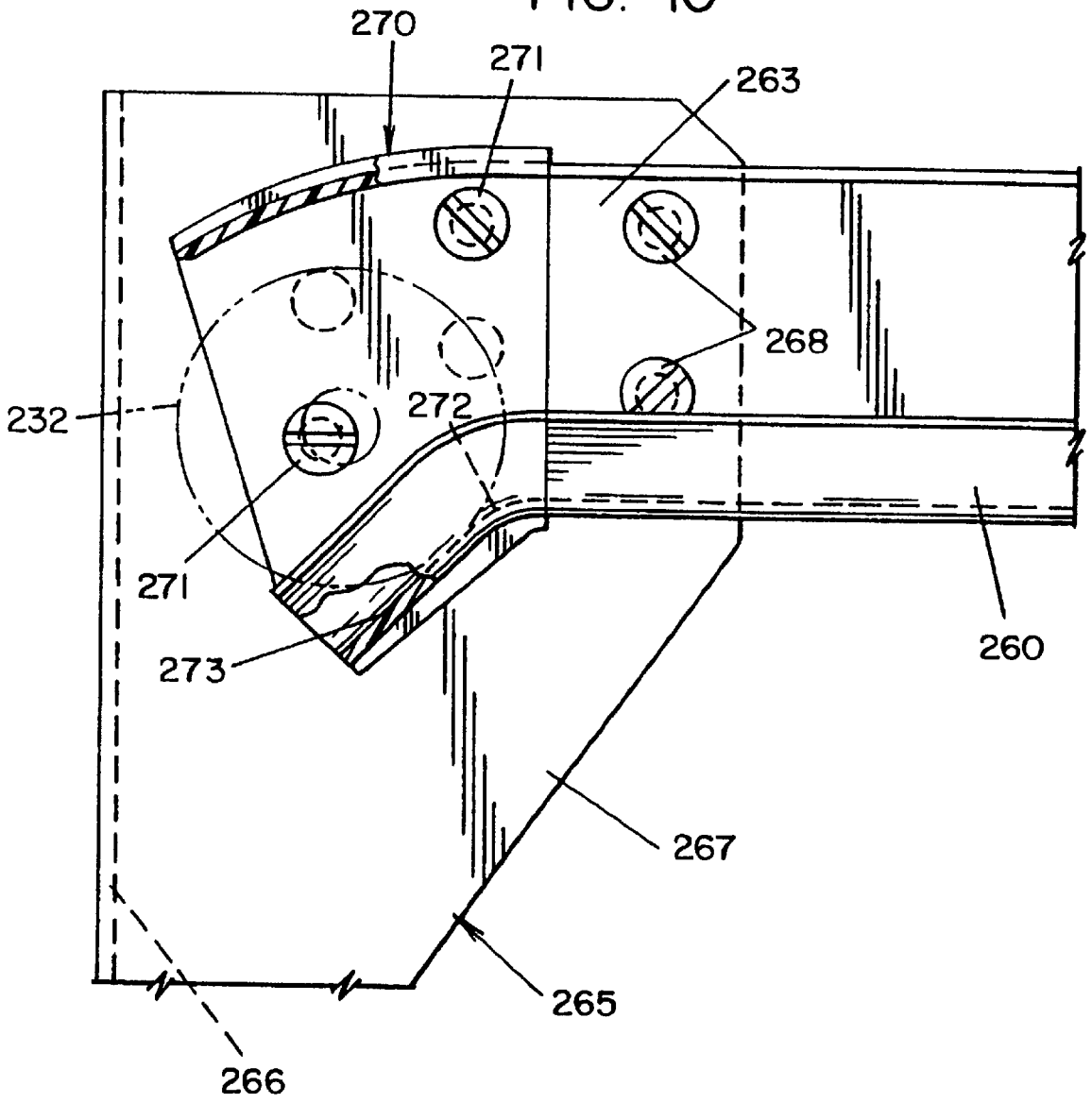
FIG. 10 is an enlarged, fragmentary, side-elevational view of a portion of FIG. 8 showing details of the upper horizontal track and the interconnected angular ramp.

The upper auxiliary horizontal track sections 260 have proximate ends 263 in substantial alignment with the bottom of the header 215 as supported by flag angles, generally indicated by the numeral 265. As shown, the flag angles 265 consist of L-shaped vertical members having a leg 266 overlying and attached to the respective jamb brackets 213 and 214 and the header 215. The flag angles 265 have projecting legs 267 which extend substantially perpendicular to the legs 266 and have the proximate ends 263 of upper auxiliary horizontal track section 260 attached thereto as by bolts 268, as seen in FIGS. 8 and 10, or other fasteners. If desired, the flag angles 265 may have a second projecting leg 269 to which the vertical track sections 251 and the transition track sections 253 may be attached as by bolts 269 or other fasteners.

The proximate ends 263 of upper auxiliary horizontal track sections 260 transcend into door-seating assemblies, generally indicated by the numeral 270, which, as best seen in FIGS. 8 and 10, is a short contoured track section. The door-seating assemblies 270 preferably have a cross-sectional configuration substantially the same as the track sections 260 and are adjustably positioned in relation thereto by selective attachment to the legs 267 of flag angles 265 as by bolts 271 or other fasteners. The door-seating assemblies 270 have curved surfaces 272 for engaging the running surface of upper roller 232, which is relatively sharply downwardly directed and merges into a linear ramp 273 that is downwardly and outwardly inclined toward header 215 preferably at an angle in the range of approximately twenty degrees to sixty degrees with respect to horizontal track sections 260.

It will thus be appreciated that the upper rollers 232 at the top edge 231 of top panel 221 are maintained within upper auxiliary horizontal track sections 260 or door seating assemblies 270 at all times during travel of the door D'. When the sectional door D' is moved from the open horizontal position to the closed vertical position, the rollers 232 enter door-seating assemblies 270 just prior to reaching the closed position. At that time, the rollers 232 pass over the curved surfaces 272 and embark upon the ramps 273, which facilitates seating of top panel 221 against the peripheral molding 216 of header 215 to securely close the top panel 221 in vertical alignment with the remainder of the panels 224, 225, and 226. The inclined ramps 273 maintain the top panel 221 in its seated position until sufficient vertical opening forces are applied to the door D', such that the rollers 232 can transcend the inclined ramps 273 and curved sections 272 to commence horizontal traverse in the upper auxiliary horizontal track sections 260.

The upper auxiliary horizontal track sections 260 have rear ends 264 at the opposite extremity from the proximate ends 263. Each of the rear ends 264 of upper auxiliary track sections 260 carry a rear mounting bracket, generally indicated by the numeral 275, in FIGS. 8 and 9. The rear mounting bracket 275, as shown particularly in FIG. 9, may be of a general angle iron configuration, including a vertical leg 276 and a horizontal leg 277. The vertical leg 276 is preferably attached proximate the rear end 264 of upper auxiliary horizontal track sections 260 and may be advantageously attached thereto and to lower horizontal track sections 255 as by welds 278 to interconnect the track sections 255 and 260 and to provide a rigid mounting for the rear mounting bracket 275.

Figure 9:
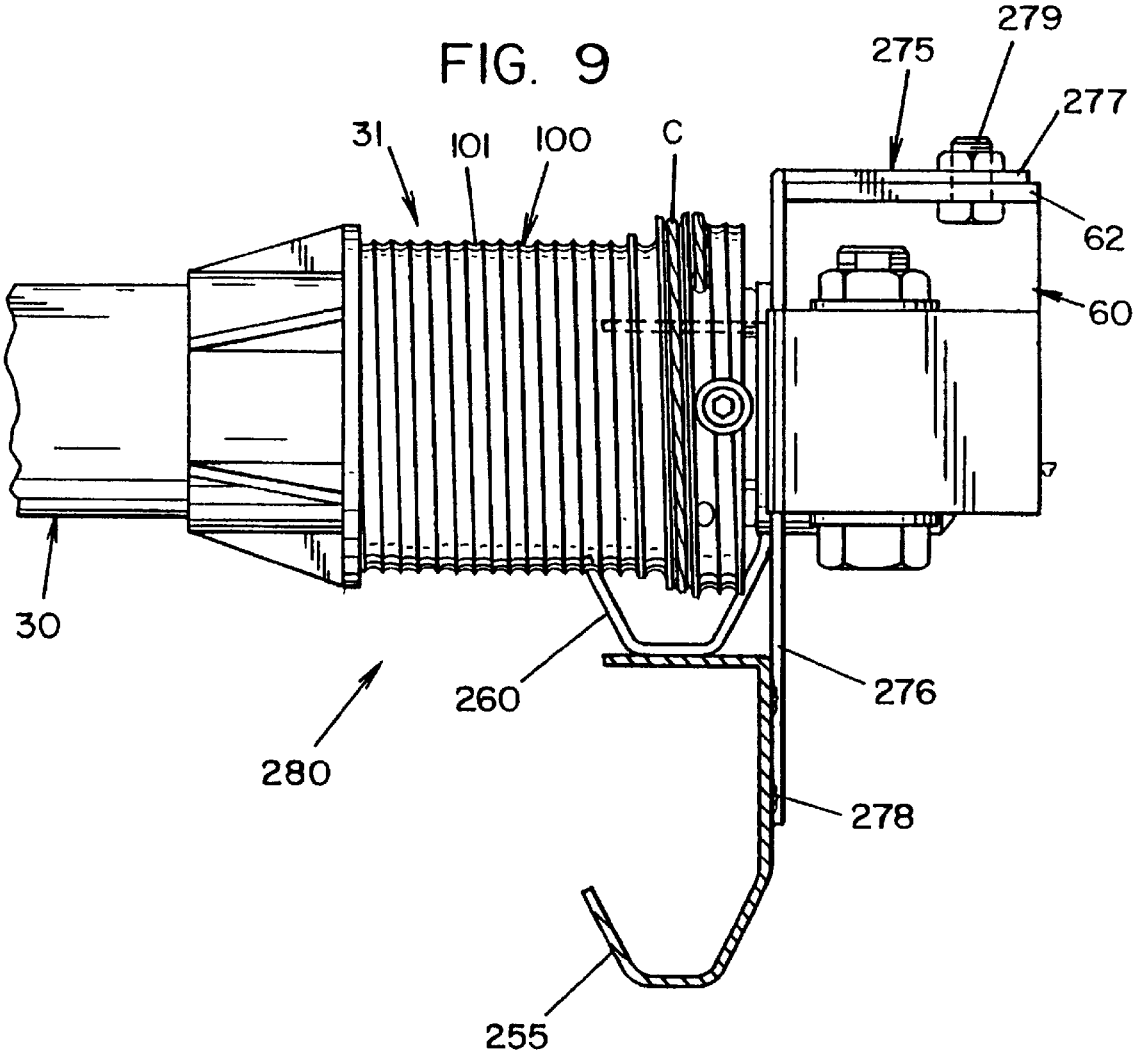
FIG. 9 is a fragmentary, rear-elevational view taken substantially along the line 9—9 of FIG. 8 of one side of the track and counterbalancing system of the alternative arrangement for mounting the counterbalancing system.

As shown, the rear mounting bracket 275 supports a counterbalancing system, generally indicated by the numeral 280, as seen in FIGS. 8 and 9. In view of the highly compact dimensions of the components, the relative placement of the structural elements, and other features described hereinabove, the counterbalancing system 280 may, as best seen in FIG. 9, employ the elongate drive tube 30 and tensioning assemblies 31 and 32, all as detailed hereinabove in conjunction with the counterbalancing system 10. As shown, the tensioning assemblies 31, 32 may be attached to the rear mounting brackets 275 by affixing backing plates 62 of the end brackets 60 to the horizontal leg 277 of rear mounting bracket 275 as by bolts and nuts 279 or other similar fasteners. A center bracket 40 may support drive tube 30 from the overhead O at a position substantially medially thereof. As best seen in FIG. 9, with the counterbalancing assemblies 280 thus mounted, such are essentially in alignment with the upper auxiliary horizontal track sections 260 and extend only a slight distance laterally outwardly thereof and thereabove such as to be substantially within the confines of the track sections 260, 260. The counterbalance systems 280 include cable drum mechanisms 100 which have the upper extremity of the grooved surface 101 positioned slightly above and axially within the upper auxiliary horizontal track sections 260. The helical grooves 101 direct the cable C of the counterbalance assemblies 280 forwardly toward the header 215 and minimally above the door D'.

The cables C are engaged at a position spaced from the door header 215 by direction change pulley mechanisms, generally indicated by the numeral 285. The direction change pulley mechanisms 285 divert the direction of the cable C from the horizontal position slightly above the door D' when in the open horizontal position downwardly to the bottom panel 224 of the door D' for attachment as described hereinafter. As best seen in FIG. 8, each of the direction change pulley mechanisms consist of a sheave 286 which is grooved in conventional fashion to receive the cable C and a shaft 287 upon which the sheave 286 freely rotates. The shaft 287 and thus the sheave 286 are supported on mounting brackets 288 which may be attached to one or both of the tracks 260, 253 as by welds 289, which may secondarily interconnect and rigidify the track sections 253, 260.

The end of the cables C opposite to that attached to cable drum mechanisms 100 is anchored to brackets 290, which are preferably affixed proximate the bottom edge of the bottom panel 224 of the door D'. As shown particularly in FIGS. 7 and 8, the bottom door bracket 290 extends outwardly a short distance from the inner surface of the panel 224 and may be of essentially conventional configuration in carrying a pin 291 to which the end of cable C may be affixed as by a cable clamp (not shown) or other conventional fastening elements.

The positioning of the direction change pulley assembly 285 is effectively controlled by the balancing of a plurality of factors which are to some extent conflicting. Initially, it will be appreciated that the further the bottom edge of bottom panel 224 moves upwardly and to the right, as viewed in FIG. 8, as sheave 286 is offset a greater distance from header 215, the greater the clearance below the door D' for a given height of header 215. This is because the door D' cannot proceed further to the right or toward an open position than when cable C, shown in chain lines in the extreme position C' in FIG. 8, is directly vertically suspended from the sheave 286. However, the further the bottom door panel 224 is displaced inwardly from frame 212 in the horizontal open position depicted in chain lines as 224', the longer the tracks 255 and tracks 260 must be to accommodate the door D' and the more material required. In addition, as the direction change pulley assembly 285 is moved inwardly from the header 215, the greater the angle at which cable C exerts force on bracket 290 and thus the bottom of door panel 224. It will be appreciated by persons skilled in the art that increasingly greater angles between the cable C and the vertical track section 251, the less the vertical lifting force component exerted on the door D', such that stronger forces must be generated by tensioning assemblies 31 and 32. A balancing of these factors thus depends on the geometry and requirements of a particular system.

Figure 11:
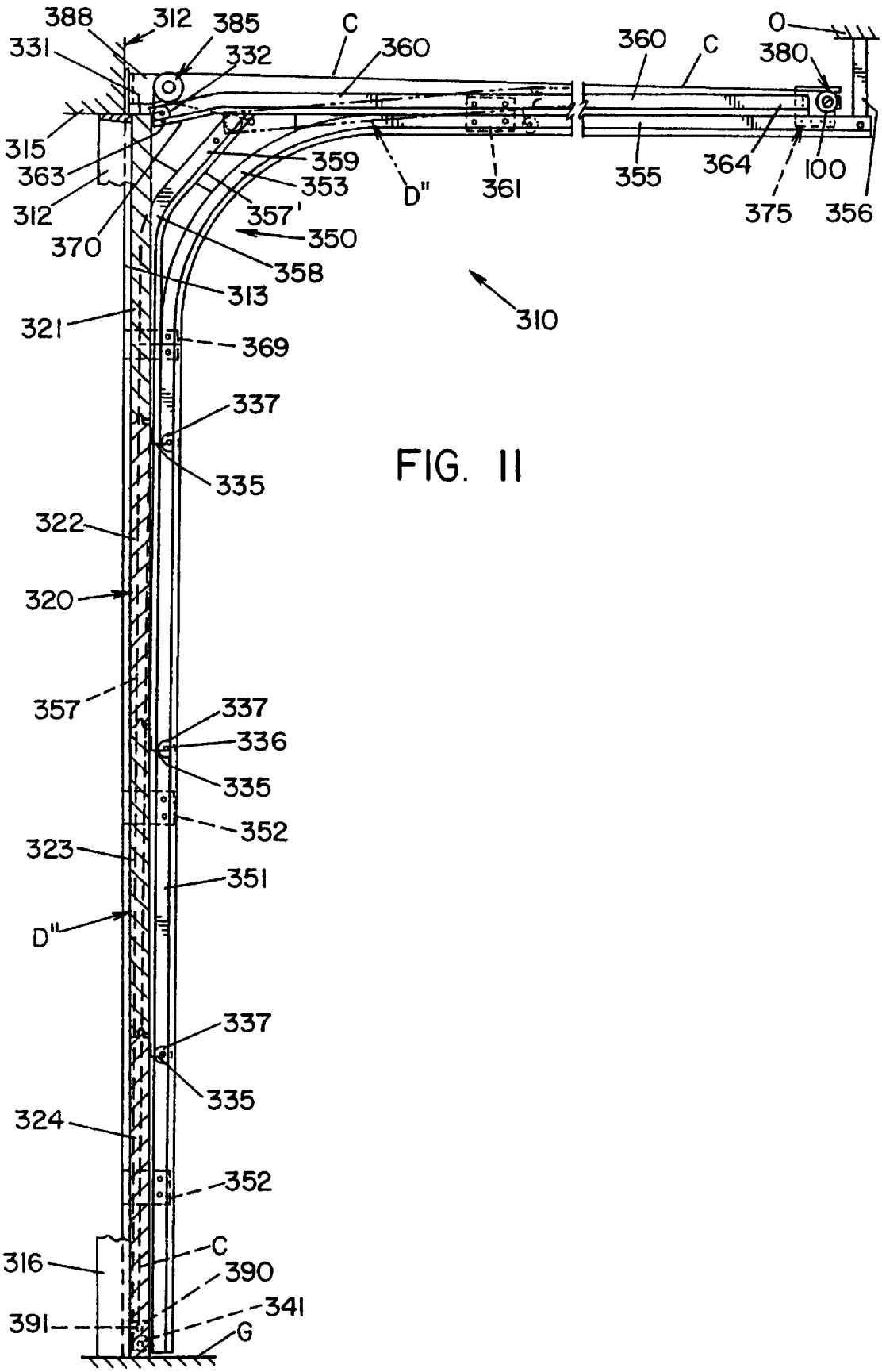
FIG. 11 is a fragmentary, side-elevational view of a second alternate rearmounted counterbalance system as viewed in relation to the inside of a sectional door and showing details of the dual vertical and horizontal track configuration.
Figure 12:
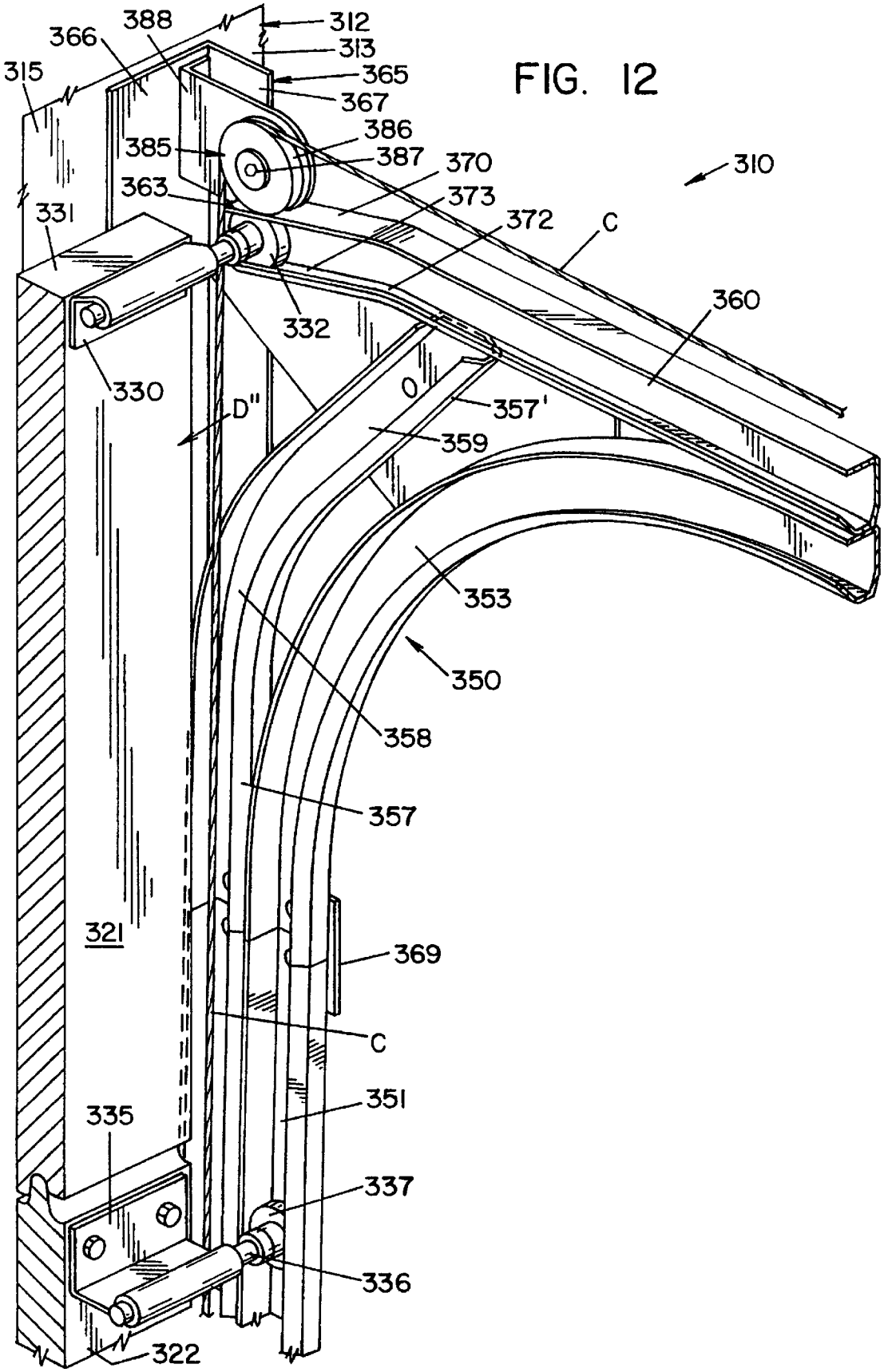
FIG. 12 is an enlarged fragmentary, perspective view of an upper corner of the rear-mounted counterbalance system of FIG. 11 showing a portion of the track arrangement and the location of the cable sheath, with the door in the closed position.

A second alternate rear-mounted counterbalance system with a compact track system is shown in the form of the overhead door mounting system, generally indicated by the numeral 310, in FIGS. 11 and 12. Since the structure to either side of the door D" is identical, except that each is the mirror image of the other, only the right-hand side is shown and described hereinafter. The door mounting system 310 is shown in relation to a conventional sectional door D" of the type commonly employed in residential garages, utility buildings, and the like. The opening in relation to which the door D" is positioned for opening and closing movements is surrounded by a door frame, generally indicated by the numeral 312, which consists of a pair of spaced jamb members 313 that are generally parallel and extend vertically upwardly from a garage floor or ground G in the manner depicted in FIG. 8 in conjunction with door mounting system 210. The jambs 313 are spaced and joined at their vertically upper extremity by a header 315 to thereby form generally U-shaped frame 312 around the opening for the door, generally indicated by D". A peripheral molding 316 may overlie and extend inwardly of the frame 312 to form a co-planar door engaging surface. The frame 312 may be conventionally constructed, as indicated hereinabove, in conjunction with the frame 12.

As seen in FIG. 11, the sectional door D" consists of a rectangular arrangement of panels, generally indicated by the numeral 320, including a top panel 321, an adjacent upper middle panel 322, an adjacent lower middle panel 323, and an adjacent bottom panel 324. The top panel 321 has top brackets 330 positioned at either side near the top edge 331, each of which mounts a top roller 332 that is offset from door D" a slight distance. As best seen in FIGS. 11 and 12, hinge brackets 335 having pivot pins 336 and intermediate rollers 337 are positioned proximate the juncture of panels 321 and 322, the juncture of panels 322 and 323, and the juncture of panels 323 and 324 at either side of door D". The brackets 335 may have vertically upwardly progressively greater offsets of the rollers 337 with respect to the door panels to assist in bringing the door D' downward and progressively into contact with the peripheral molding 316 of jamb brackets 313 in a manner well known in the art. A bottom roller 341 is positioned at the lower edge of the bottom panel 324, preferably centered substantially medially of the thickness of the door D", as best seen in FIG. 11.

Referring still to FIGS. 11 and 12, the door mounting system 310 has the door D" movably interrelated with the frame 312 by a track system, generally indicated by the numeral 350. The track system 350 has inner vertical track sections 351 to either side of the door D" extending from the ground G constituting the floor of a garage or other structure to a position somewhat below the header 315 of the frame 312. The inner vertical track sections 351 are positioned laterally of and vertically with respect to jambs 313 as by a plurality of conventional jamb brackets 352. The inner vertical track sections 351 are connected to curved transition track sections 353, which may be an involute transcending through approximately ninety degrees and terminating in a substantially horizontal orientation at a height substantially in vertical alignment with the top edge 331 of top panel 321 of the door D" in the closed vertical position, as best seen in FIG. 11. The transition track sections 353 merge into or are connected to lower horizontal track sections 355 which extend rearwardly from, and are substantially perpendicular to, frame 312. The lower horizontal track sections 355 are supported proximate their rearward extremity by struts 356 which may be attached to the overhead O thereabove in a conventional fashion well known in the art.

The track system 350 has outer vertical track sections 357 which are interposed between the door frame 312 and the inner vertical track sections 351 and, like the inner vertical track sections 351, are positioned and retained by the jamb brackets 352. The outer vertical track sections 357 extend from the ground G vertically to an upper extremity which is substantially in horizontal alignment with lower horizontal track sections 355. As shown, the outer vertical track sections 357 are substantially parallel to, and preferably substantially coplanar with and in abutting relation to, the inner vertical track sections 351 over substantially the entire length thereof. The upper extremities 357' of outer vertical track sections 357 horizontally opposite the curved transition track sections 353 are inwardly offset and consist of angle track segments 358 and a substantially linear track segments 359 which extend in the direction of transition track sections 353. As shown, linear track segments 359 are disposed at an angle of approximately forty-five degrees to the vertical portion of outer vertical track sections 357. It is to be appreciated that for various geometric configurations, the angle might be of lesser or greater magnitude for each linear track segment 359, and linear track segment 359 could be replaced by a curvilinear track segment. This arrangement permits the door D" to assume a substantially planar, nearly horizontal orientation in the open position.

The track system 350 also has upper auxiliary horizontal track sections 360. As shown, the upper auxiliary horizontal track sections 360 are substantially parallel with, are preferably in substantially vertical coplanar alignment with, and are preferably in abutting longitudinal engagement with the lower horizontal track sections 355. Optionally, the track sections 355 and 360 may be welded along their entire abutting surfaces to impart additional strength and rigidity thereto. If desired, one or more reinforcing plates 361 may be attached to both of the adjacent track sections 355 and 360 as by welds for further strengthening.

The upper auxiliary horizontal track sections 360 have proximate ends 363 in substantial alignment with the bottom of the header 315 as supported by flag angles, generally indicated by the numeral 365 in FIG. 12. As shown, the flag angles 365 consist of L-shaped vertical members having a leg 366 overlying and attached to the respective jamb brackets 313 and 314 of the header 315. The flag angles 365 have projecting legs 367 which extend substantially perpendicular to the legs 366 and have the proximate ends 363 of upper auxiliary horizontal track section 360 attached by fasteners. If desired, the flag angles 365 may have a second projecting leg 369 to which the vertical track sections 351 and the transition track sections 353 may be attached by fasteners.

The proximate ends 363 of upper auxiliary horizontal track sections 360 transcend into door-seating assemblies, generally indicated by the numeral 370, which, as seen in FIGS. 11 and 12, are a short contoured track section. The door-seating assemblies 370 preferably have a cross-sectional configuration substantially the same as the track sections 360 and may be formed integrally with track sections 360 or constituted as separate adjustably positioned components in the manner of door-seating assemblies 270. The door-seating assemblies 370 have downwardly angled surfaces 372 for engaging the running surface of upper rollers 332. The surfaces 372 merge into linear ramps 373 that are downwardly and outwardly inclined toward header 315 preferably at an angle of approximately twenty degrees with respect to horizontal track sections 360.

It will thus be appreciated that the upper rollers 332 at the top edge 331 of top panel 321 are maintained within upper auxiliary horizontal track sections 360 or door-seating assemblies 370 at all times during travel of the door D". When the sectional door D" is moved from the open horizontal position to the closed vertical position, the rollers 332 enter door-seating assemblies 370 just prior to reaching the closed position. At that time, the rollers 332 pass over the angled surfaces 372 and embark upon the downwardly inclined ramps 373, which facilitate seating of top panel 321 against the peripheral molding 316 of header 315 to securely close the top panel 321 in vertical alignment with the remainder of the panels 322, 323, and 324. The inclined ramps 373 maintain the top panel 321 in its seated position until sufficient vertical opening forces are applied to the door D", such that the rollers 332 can transcend the inclined ramps 373 and angled surfaces 372 to commence horizontal traverse in the upper auxiliary horizontal track sections 360.

Referring to FIG. 11, the upper auxiliary horizontal track sections 360 have inner ends 364 at the opposite extremities from the proximate ends 363. The inner ends 364 of upper auxiliary track sections 360 carry rear mounting brackets, generally indicated by the numeral 375, which may be identical to rear mounting brackets 275 of FIGS. 8 and 9.

As shown, the rear mounting brackets 375 support a counterbalance system, generally indicated by the numeral 380, as seen in FIG. 11. In view of the highly compact dimensions of the components, the relative placement of the structural elements, and other features described hereinabove, the counterbalance system 380 may, as best seen in FIG. 11, employ the elongate drive tube 30 and tensioning assemblies 31 and 32, all as detailed hereinabove in conjunction with the counterbalance system 10.

The counterbalance system 380 thus mounted, is essentially in alignment with the upper auxiliary horizontal track sections 360 and extends only a slight distance laterally outwardly thereof and thereabove such as to be substantially within the confines of the track sections 360. The counterbalance system 380 includes cable drum mechanisms 100 which are positioned slightly above and axially within the upper auxiliary horizontal track sections 360. Cable drum mechanisms 100 direct the cable C of the counterbalance assemblies 380 forwardly toward the header 315 and minimally above the door D".

The cables C are engaged at a position preferably proximate to the door header 315 by direction change pulley mechanisms, generally indicated by numeral 385. The direction change pulley mechanisms 385 divert the direction of the cable C from the horizontal position slightly above the door D" when in the open horizontal position downwardly to the bottom panel 324 of the door D" for attachment as described hereinafter. As best seen in FIG. 12, each of the direction change pulley mechanisms consist of a sheave 386, which is grooved in conventional fashion to receive the cable C, and a shaft 387 upon which the sheave 386 freely rotates. The shaft 387 and thus the sheave 386 are supported on mounting brackets 388 which may be attached to the flag angles 365.

The end of the cables C opposite to that attached to cable drum mechanisms 100 is anchored to brackets 390, which are preferably affixed proximate the bottom edge of the bottom panel 324 of the door D". As shown in FIGS. 11, the bottom door bracket 390 may be an essentially conventional configuration in carrying a pin 391 to which the end of cable C may be affixed as by a cable clamp (not shown) or other fastening elements.

Thus, it should be evident that the rear mount counterbalance system for sectional doors disclosed herein carries out various of the objects of the present invention set forth above and otherwise constitutes an advantageous contribution to the art. As will be apparent to persons skilled in the art, modifications can be made to the preferred embodiments disclosed herein without departing from the spirit of the invention, the scope of the invention being limited solely by the scope of the attached claims.

What is claimed is:

1. An overhead door system comprising, a sectional door having top, bottom, and intermediate panels hinged for moving between a closed vertical position and an open horizontal position, top rollers on said top panel, bottom rollers on said bottom panel, intermediate rollers positioned between said top rollers and said bottom rollers, inner vertical tracks for engaging said intermediate rollers, transition tracks connected to said inner vertical tracks and curving through an angle of approximately ninety degrees for directing the travel of said intermediate rollers, horizontal tracks extending from said transition tracks for engaging said intermediate rollers to support the door in the open horizontal position, and outer vertical tracks for guiding said bottom rollers in a substantially vertical path paralleling said inner vertical tracks and having upper extremities that are inwardly offset in the direction of said transition tracks.

2. An overhead door system according to claim 1, wherein said inner vertical tracks and said outer vertical tracks are in abutting longitudinal engagement.

3. An overhead door system according to claim 1, wherein said inner vertical tracks and said outer vertical tracks are substantially coplanar.

4. An overhead door system according to claim 1, wherein the upper extremities of said outer vertical tracks are in substantially horizontal alignment with said horizontal tracks.

5. An overhead door system according to claim 1, wherein said horizontal tracks include upper horizontal tracks and lower horizontal tracks, said lower horizontal tracks interconnecting with said transition tracks.

6. An overhead door system according to claim 6, wherein said upper extremities of said outer vertical tracks terminate proximate to said upper horizontal tracks.

7. An overhead door system according to claim 5, wherein said upper horizontal tracks have outer extremities and inner extremities and have door seating assemblies at said outer extremities thereof.

8. An overhead door system according to claim 7, wherein said door seating assemblies include downwardly and outwardly inclined ramps for guiding said top rollers.

9. An overhead door system according to claim 8, wherein said ramps have an angled surface and a linear surface disposed downwardly at an angle of approximately twenty degrees.

10. An overhead door system according to claim 1, wherein said upper extremities of said outer vertical tracks have angle track segments and linear track segments.

11. An overhead door system according to claim 10, wherein said linear track segments are disposed inwardly at an angle of approximately forty-five degrees relative to said portion of said outer vertical tracks paralleling said inner vertical tracks.

12. An overhead door system according to claim 1, wherein said bottom rollers are positioned substantially medially of the thickness of said bottom panel.

13. An overhead door system according to claim 12, wherein said top, bottom, and intermediate panels are substantially planar when said sectional door is in said open horizontal position.

14. An overhead door system according to claim 1, wherein said intermediate rollers are positioned between said top panel and one of said intermediate panels, between said bottom panel and one of said intermediate panels, and between said intermediate panels.

15. An overhead door system according to claim 1, wherein said intermediate rollers are offset different distances inwardly of the said intermediate panels.

16. An overhead door system according to claim 1, wherein said horizontal tracks have inner ends and further comprising, a counterbalance system mounted proximate said inner ends of said horizontal tracks, cables interconnecting said counterbalance system and said bottom panel of said sectional door, and pulley mechanisms effecting a change of direction of said cable for substantially following said horizontal tracks and said vertical tracks.

17. An overhead door system according to claim 16, wherein said cables are attached to said bottom panel of said sectional door proximate to a bottom edge thereof.

18. An overhead door system comprising, a sectional door having top, bottom, and intermediate panels hinged for moving between a closed vertical position and an open horizontal position, top rollers on said top panel, bottom rollers on said bottom panel, intermediate rollers positioned between said top rollers and said bottom rollers, inner vertical tracks for engaging said intermediate rollers, transition tracks connected to said inner vertical tracks and curving through an angle of approximately ninety degrees for directing the travel of said intermediate rollers, lower horizontal tracks extending from said transition tracks for engaging said intermediate rollers to support the door in the open horizontal position, outer vertical tracks for guiding said bottom rollers in a substantially vertically path when moving between said open horizontal position and said closed vertical position of the door and upper horizontal tracks for guiding said top rollers on said top panel.

19. An overhead door system according to claim 18, wherein said outer vertical tracks have upper ends that are inwardly offset in the direction of said transition tracks.

20. An overhead door system according to claim 19, wherein said upper horizontal tracks have door seating assemblies for securely seating said top panel in the closed vertical position.

21. An overhead door system according to claim 20, wherein said upper ends of said outer vertical tracks terminate proximate to said upper horizontal tracks and inwardly of said door seating assemblies.

22. An overhead door system comprising, a sectional door having top, bottom, and intermediate panels hinged for moving between a closed vertical position and an open horizontal position, top rollers on said top panel, bottom rollers on said bottom panel, intermediate rollers positioned between said top rollers and said bottom rollers on said intermediate panels, horizontal tracks for guiding said top rollers on said top panel and having door seating assemblies for securely seating said top panel in the closed vertical position, and vertical tracks for guiding said bottom rollers and having upper ends that terminate proximate to said horizontal tracks and inwardly of said door seating assemblies.

* * * * *